US006118087A

United States Patent [19]

Fukui

[11] Patent Number: 6,118,087

[45] Date of Patent: Sep. 12, 2000

[54] SAFETY SWITCH

[75] Inventor: Takao Fukui, Osaka, Japan

[73] Assignee: IDEC Izumi Corporation, Osaka, Japan

[21] Appl. No.: 09/049,098

[22] Filed: Mar. 27, 1998

[30] Foreign Application Priority Data

Mar. 31, 1997 [JP] Japan ..... 9-080265
Apr. 30, 1997 [JP] Japan ..... 9-112260

[51] Int. Cl.[7] ..... H01H 27/00
[52] U.S. Cl. ..... 200/43.04; 200/61.52
[58] Field of Search ..... 200/529, 533, 200/525

[56] References Cited

U.S. PATENT DOCUMENTS 5,420,385 5/1995 Cooper ..... 200/43.07
5,464,954 11/1995 Kimura et al. ..... 200/61.62
5,622,253 4/1997 Wecke et al. ..... 200/43.07

FOREIGN PATENT DOCUMENTS 0 117 396 9/1984 European Pat. Off. .
0 330 229 A2 A3 8/1989 European Pat. Off. .
295 15 529 U1 2/1996 Germany .

*Primary Examiner*—Lincoln Donovan
*Assistant Examiner*—Nhung Nguyen
*Attorney, Agent, or Firm*—Armstrong, Westerman, Hattori, McLeland & Naughton

[57] ABSTRACT

A safety switch that is constructed to change over the connection contact when an actuator enters the operating portion of the switch proper and an operating rod at the switch portion moves in response to this. The safety switch includes a driving cam and restricting plates arranged on either side of the driving cam for restricting movement of the driving cam when an object other than the actuator is inserted into the operating portion.

16 Claims, 31 Drawing Sheets

(A)

(B)

SAFETY SWITCH

BACKGROUND OF THE INVENTION

1. Field of the Invention

The present invention relates to a safety switch which is mounted on the wall surface of a doorway of a room in which, for example, industrial machinery is installed, and which stops the power supply to the industrial machinery, etc. when the door of the doorway is opened.

2. Description of the Related Art

In a hazardous zone of the rooms or plants in which industrial machinery is installed, or industrial machinery itself, a system for locking the drive of the machine is required to be installed when the door of the doorway in the room or a danger zone is not completely closed, in order to prevent troubles in which workers are caught in by the machine and injured.

For such a lock system, conventionally, a system has been adopted to install limit switches at the sliding portions of the door and to supply power to the industrial machinery installed in the room only when the door closed condition is detected by the limit switches.

However, according to this kind of system, operating the actuator of the limit switch without closing the door enables the operation of the machines in the room, and it cannot be said to be a perfect safety measure.

Therefore, the inventor has already proposed a safety switch which has a construction for preventing this kind of misoperation (Japanese Non-examined Patent Publication No. Hei 6-76674).

The safety switch of this proposal is a switch which has a construction in which the special-purpose of the actuator fixed to the door enters the operating portion of the switch proper mounted to the wall surface in the circumference of the doorway of the room when the door of the doorway is closed, and with this action, the mobile contact of the contact block is changed over, and with this kind of change-over operation, the circuit connection is changed over to the main circuit side (power supply circuit to industrial machinery), causing the machines inside the room to be ready for operation.

Now, there is no special problem in functions, safety, etc. with the existing safety switch, etc. stated in the Japanese Non-examined Patent No. Hei 6-76674, but according to the proposed safety switch, because a driving cam and restricted cam (both are plate cams) with groove cams formed, respectively, are arranged at the operating portion, the rotating phase difference is provided between the driving cam and the restricted cam, and all the cams are rotated to change over the connection contacts of the switch portion only when the special-purpose actuator enters the operating portion, it is inevitable that the profile, processing, etc. of each cam be complicated, and if there is any deviation in positional relationship of groove cams between the driving cam and the restricted cam, there is a fear of causing maloperation, and it is essential to process the groove cam of each cam at high accuracy.

SUMMARY OF THE INVENTION

It is an object of this invention to provide a safety switch which has a simple construction, is low-cost, and at the same time achieves safety equivalent to that of conventional ones.

In order to achieve this object, the safety switch of this invention is a switch constructed to change over a connection contacts by the actuator entering the operating portion of the switch proper and moving the operating rod of the switch portion correspondingly, wherein the actuator has the inserting portion to the operating portion comprising a pressurizing piece at the tip end and a supporting piece for supporting the pressurizing piece, and to the pressurizing piece, are protruded portion pressurizing surfaces located on both ends and a recessed portion pressurizing surface located in-between.

To this operating portion, a driving cam is installed that rotates as the actuator advances and retracts and restricting plates are located on both sides of the driving cam and are able to rotate around the rotation center of the driving cam, respectively, and a cam follower pin is connected to the end portion of the operating rod, whose both ends extend to the side of the driving cam. To the driving cam, a groove cam is formed for providing the cam follower pin with displacement in the moving direction of the operating rod, and to each of the restricting plates, a pin engaging portion is located on the moving passage of the cam follower pin under the initial condition where the actuator is not inserted and intended to restrict the move of the follower pin, and an elastic member is included for returning the restricting plates to the initial condition, respectively.

When only the driving cam is intended to rotate under an initial condition, the movement of the cam follower pin is stopped by the restricting plate, and the rotation of the driving cam is restricted, and when the actuator is inserted, the recessed portion pressurizing surface at the tip end presses the driving cam, and the protruded portion pressurizing surfaces press the restricting plates, and both the driving cam and the restricting plates rotate together to move the operating rod.

In the safety switch of this invention of the above-mentioned construction, the motion at the operating portion can be prevented even if something other than the special-purpose actuator (for example, a screwdriver, etc.) is inserted into the insertion hole. That is, in the safety switch of this invention, because the driving cam rotates only when the driving cam and the restricting plates on both sides are pressed nearly simultaneously with the recessed portion pressurizing surface and the protruded portion pressurizing surfaces of the actuator, even if something with a flat tip end such as a screwdriver, etc. is inserted to the operating portion to rotate the driving cam, the movement of the cam follower pin is restricted by the pin engaging portion of the restricting plates when the driving cam slightly rotates, and thereby the rotation of the driving cam is prevented. In addition, because to the restricting plates, no groove cams, etc. for providing displacement to the cam follower pins are processed, even if they are rotated individually, they only idle and do not cause the operating rod to move.

Now, in the safety switch of this invention, it may be configured to have the pin guide member equipped with a guide groove for restricting the moving direction of the cam follower pin to one direction on both ends of the cam follower pin.

The driving cam and restricting plates equipped on both sides of it are desirable to be rotatably supported on the same shaft independently, respectively. The driving cam and the restricting plates are desirable to be arranged at locations that may generate, between the driving cam and the restricting plates under the initial condition, the rotating phase difference that corresponds to the level difference between the protruded pressurizing surfaces and the recessed pressurizing surface of the actuator.

In addition, it may be constructed in such a manner that the driving cam includes a hollowed-out portion extending in a specified width from the circumferential surface towards the rotation center of the driving cam formed on the portion corresponding to the groove cam formed portion, and the operating rod end portion is intended to be inserted into the hollowed-out portion, and to the rod end portion, the cam follower pin is connected.

It may also be constructed in such a manner that a recessed portion to which the pressurizing piece of the actuator is fitted is formed on the circumferential surface of the driving cam, and when the driving cam rotates as the actuator advances into the operating portion, the pressurizing piece of the actuator fits into the recessed portion of the driving cam circumferential surface. It is desirable that the recessed portion be formed at two places on the circumferential surface of the driving cam, and in correspondence to these recessed portions, an inserting hole of the actuator be provided at two places of the operating portion.

One specific example of the pin engaging portion to be equipped to the restricting plates in the safety switch of this invention includes a notch formed to a profile to which the cam follower pin fits in, and examples of the notch profile include a semi-circle or rectangle. Or, it may be configured to form a hole for relief of the cam follower pin to this restricting plates and to form the notch to the edge portion of the hole. Or the pin engaging portion of the restricting plate may be a hook-form engaging piece integrally formed on this restricting plate.

In the safety switch of this invention, for the elastic member for restoring the restricting plate to the initial condition, it is desirable to use a torsion coil spring in view of achieving the simple construction, but configurations of providing the restoring force to the restricting plate using the elastic force of compression coil springs, tension coil springs, plate springs, etc. may be adopted. When plate springs are used, it may be configured to integrally form this plate spring to the restricting plate.

In addition, the driving cam and the restricting plates may be plastic moldings.

Now, in the safety switch of this invention, a lock mechanism for preventing pull-out of the actuator that has entered the operating portion and a lock canceling means that can cancel the locking mechanism may be installed, and in such event, when the actuator enters the operating portion and the connection contacts are changed over, the lock mechanism prevents the actuator from falling off and mechanically locks the door, etc. to prevent the door, etc. from opening.

When this kind of configuration is ad opted, the lock canceling means may be designed to be an automatic lock canceling mechanism that automatically cancels the lock mechanism of the actuator in response to the electrical signals from the outside, For example, if a mechanism utilizing the solenoid is applied, when the power supply to the industrial machinery is operated to be interrupted, the operation OFF signal excites the solenoid, automatically cancels the lock by the lock mechanism, and brings the door to be ready for opening.

In addition, for other lock canceling means, a manual lock canceling mechanism for canceling the lock mechanism of the actuator by manual operation can be adopted, and specific examples include a mechanism for canceling the lock mechanism by key operation.

For other configuration, a mechanism for utilizing the lever can be mentioned. In the mechanism using the lever, a through hole reaching the inside of the operating portion may be formed on the fixing surface of the switch proper, and the lock canceling means may be operated via the through hole.

In addition, a lock canceling means may be such that both automatic lock canceling mechanism and manual lock canceling mechanism as described above are installed.

In the safety switch of this invention, connecting a switch that is normally closed and is opened when the lock is canceled by the lock canceling means in series to the connection contact to the circuit to which the contacts of the switching portion are connected can further improve the safety.

That is, if the power supply to the industrial machinery, etc. indoors is intended to be interrupted only by switching operation of the connection contacts on the switch portion side, the power supply to the industrial machinery, etc. indoors can be interrupted when the door is opened, and the workers, etc. may enter the room when the inertia motion still remains in the machines. As against this, in the safety switch provided with a lock mechanism, since the actuator is unable to be pulled out, that is, the door is unable to be opened unless the lock mechanism is canceled and the operating portion is ready for operation in advance before the door is opened, connecting the connection contacts on the switch portion side to the switch installed on the lock canceling mechanism side in series can interrupt the power supply to the industrial machinery, etc. in the room in advance when the door is still in the unopened condition when the lock is canceled, and the door is opened with a certain time difference thereafter. Consequently, if a control panel, etc. for supplying the operation OFF signal (lock canceling signal) is installed at a location slightly away from the door opening position, the inertia motion of the industrial machinery, etc. subsides while the worker, etc. move from the control panel, etc. to the door opening position, and the worker, etc. entering the room is no longer subject to dangers

BRIEF DESCRIPTION OF THE DRAWINGS

FIG. 35 is a partial cross sectional view showing another example concerning the first embodiment shown in FIG. 31.

DETAILED DESCRIPTION OF THE PREFERRED EMBODIMENTS

Figure 1:
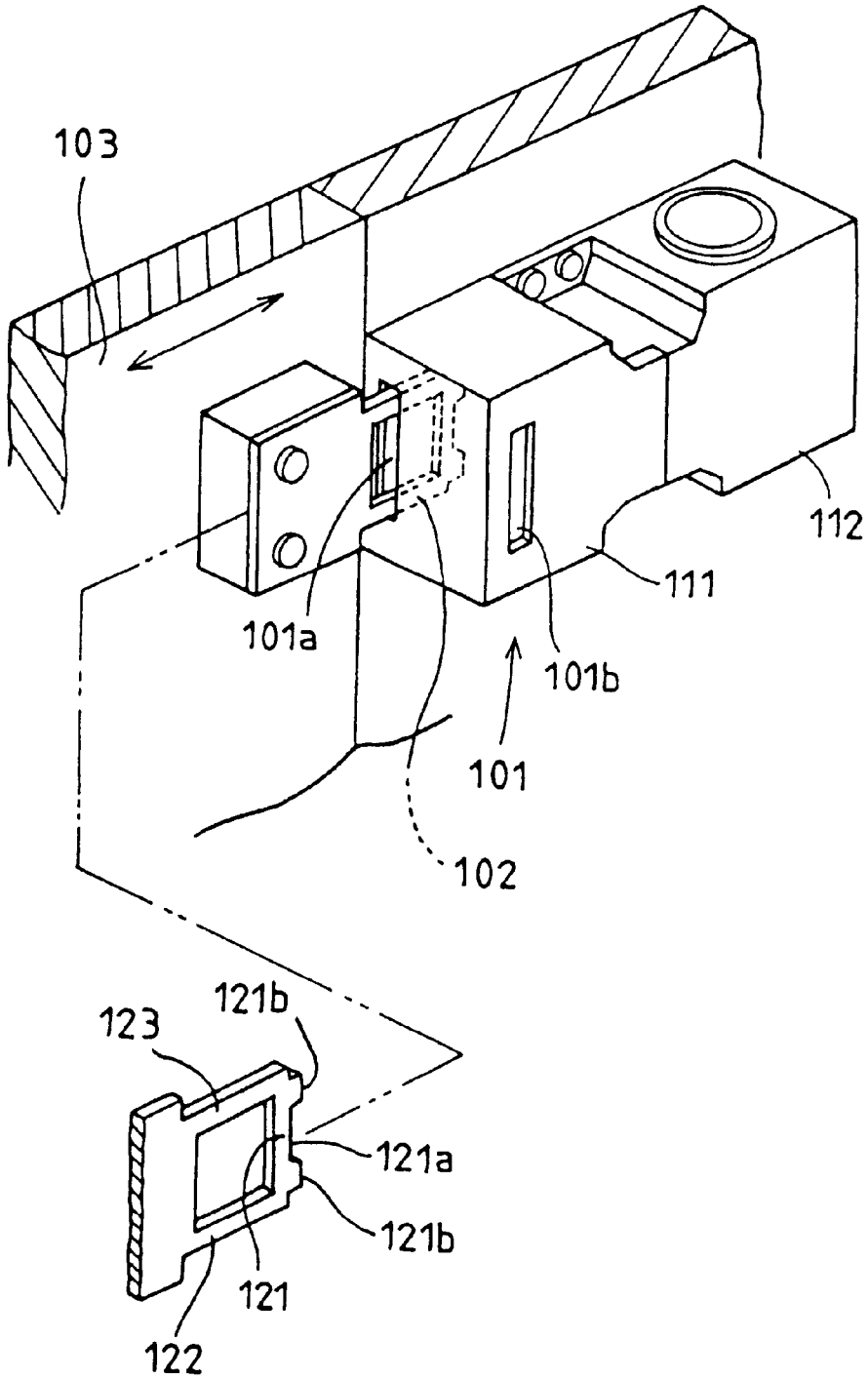
FIG. 1 is a perspective view showing a first embodiment of the present invention under the applied condition.

Referring now to the drawings, preferred embodiments according to the invention will be described in detail hereinafter.

Figure 2:
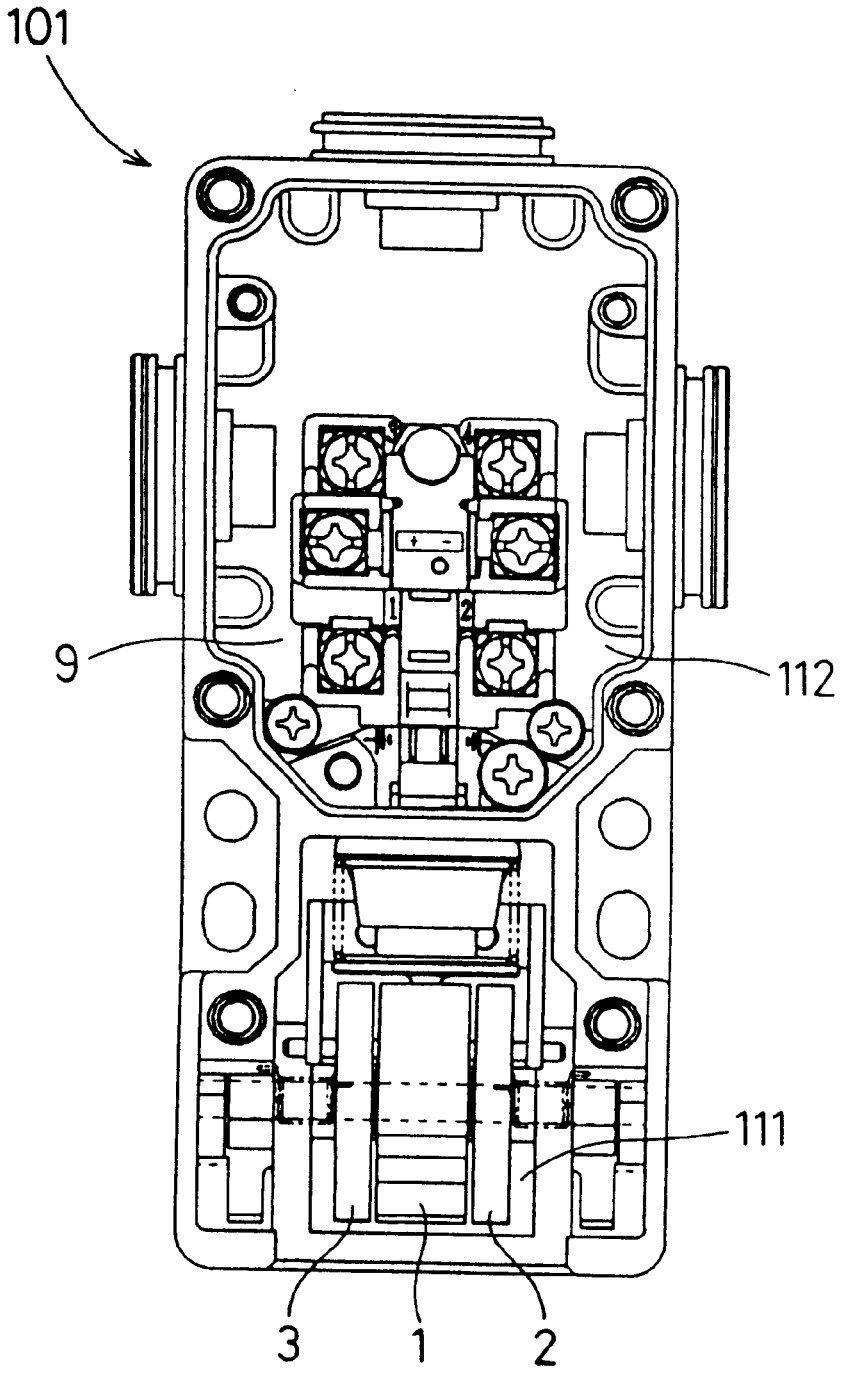
FIG. 2 is a plan view showing the configuration of the first embodiment of the present invention with a cover removed.
Figure 3:
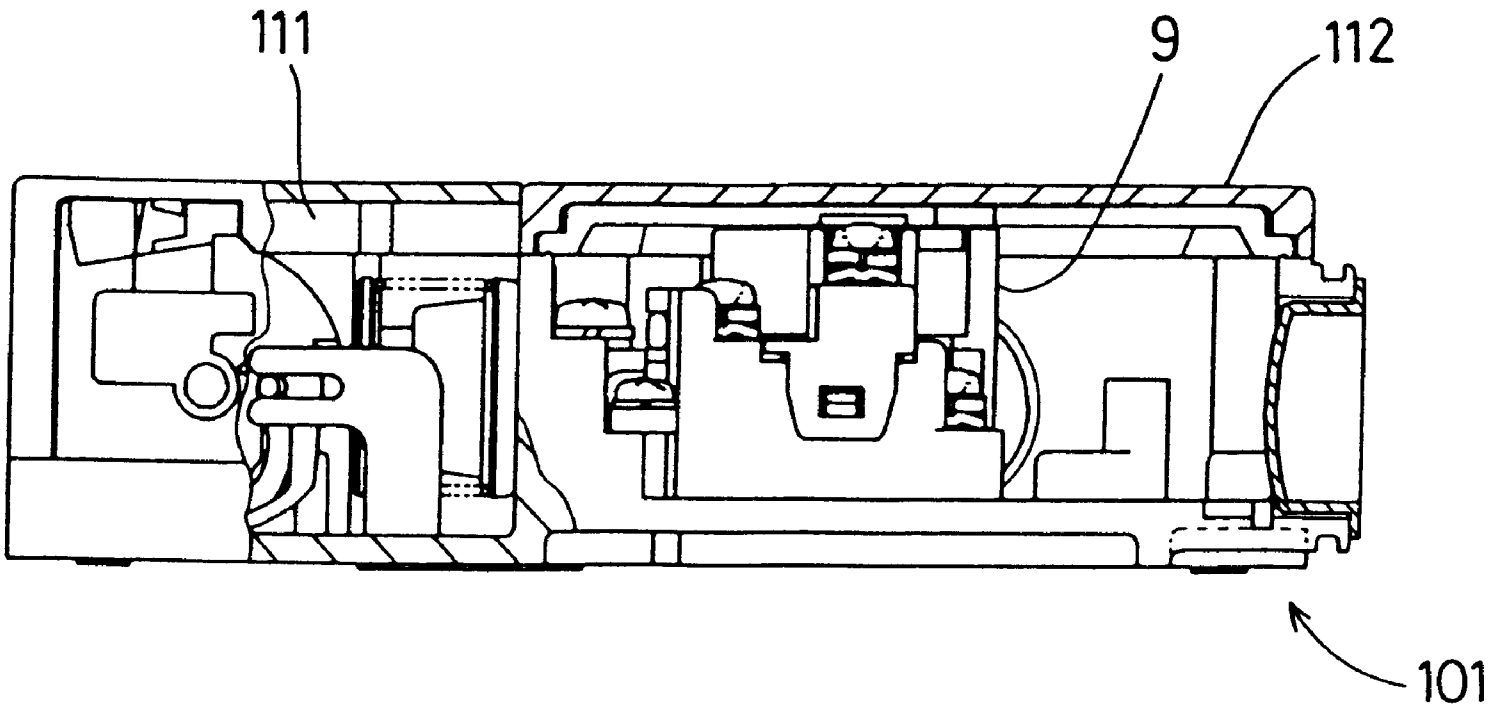
FIG. 3 is a side view showing the configuration of the first embodiment of the present invention with a cover partly broken away.

First of all, referring to FIG. 1 through FIG. 3, the construction of the safety switch according to a first embodiment is briefly described. FIG. 1 is a perspective view of the first embodiment according to the present invention under the applied condition, FIG. 2 is a plan view showing the configuration of the first embodiment according to the present invention with the cover removed, and FIG. 3 is a side view showing the configuration of the first embodiment of the present invention with a cover partly broken away.

The safety switch of this first embodiment is a switch electrically connected to the industrial machinery installed in a room, and primarily comprises a switch proper 101 and an actuator 102. The switch proper 101 is secured at the wall surface in the periphery of the doorway of the room and the actuator 102 is secured at a door 103. The actuator 102 is located at the position opposite to the insertion hole 101*a* of the switch proper and enters the operating portion 111 of the switch proper 101 when the door 103 is closed.

The entry of the actuator 102 changes over the connection contact of the contact block 9 built in the switch portion 112, and the machinery inside the room is ready for operation. On the other hand, when the actuator 102 is removed from the operating portion 111 by the opening of the door 103, the connection contact of the contact block returns to the original condition and the power supply to the machine is turned off.

The actuator 102 has the insertion portion to the operating portion 111 composed of a pressurizing piece 121 at the top end portion and a pair of supporting pieces 122, 123 for supporting both ends as shown in FIG. 1. To the pressurizing piece 121, protruded pressurizing surfaces 121*b*, 121*b* located on both end portions and a recessed pressuring surface 121*a* located in-between are formed.

Figure 4:
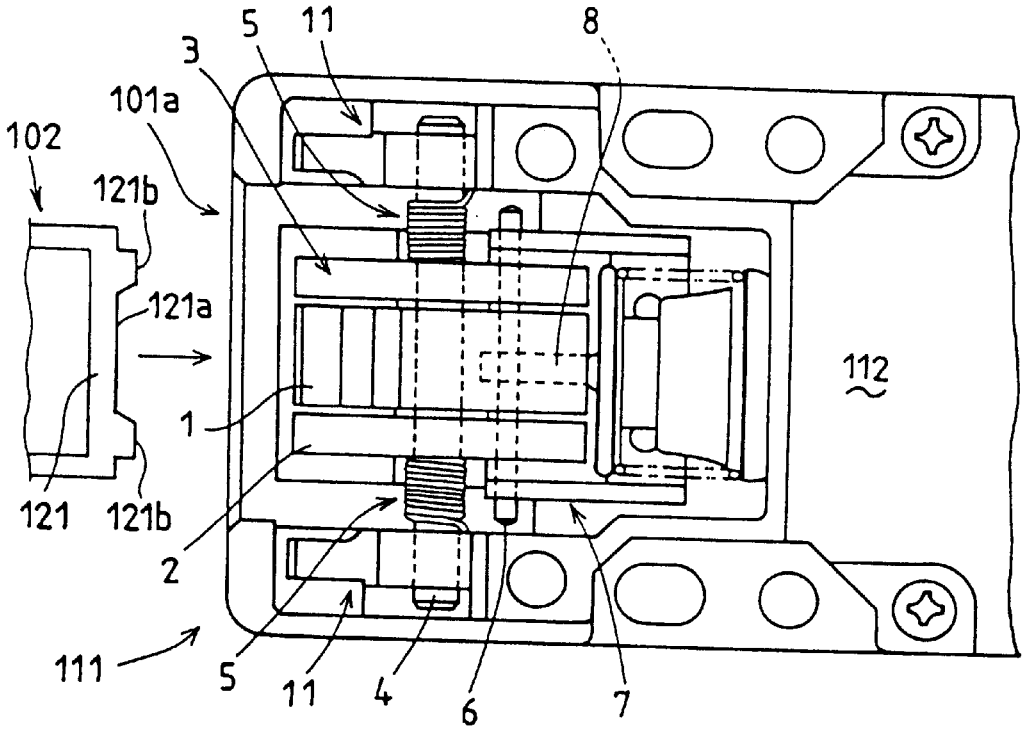
FIG. 4 is a plan view showing the configuration of the operating portion 111 of the first embodiment of the present invention with a cover removed.
Figure 5:
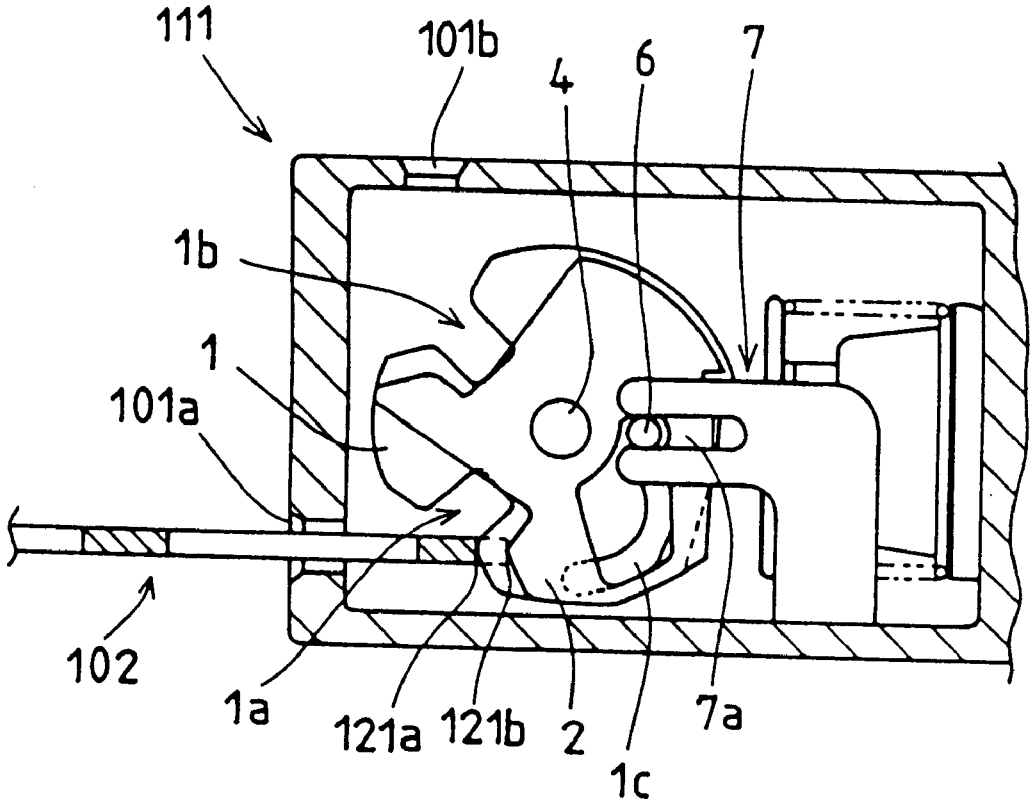
FIG. 5 is a side view showing the configuration of the operating portion 111 of the first embodiment of the present invention with a cover partly broken away.
Figure 6:
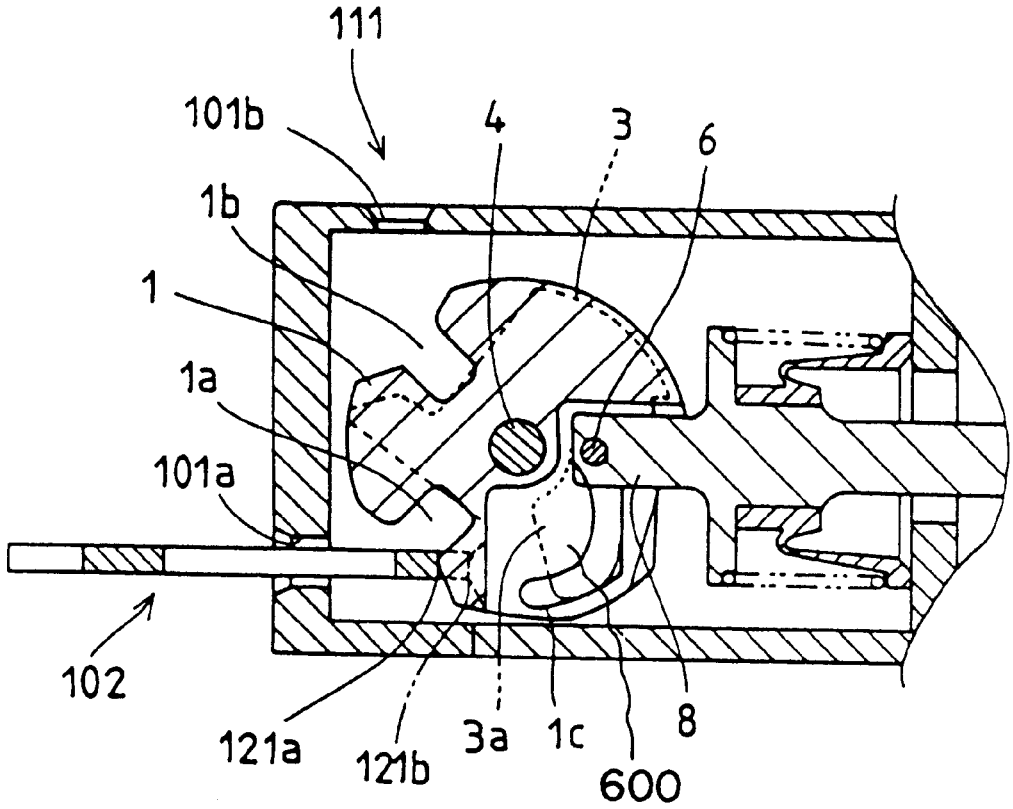
FIG. 6 is a center longitudinal sectional view of the operating portion 111 of the first embodiment of the present invention.
Figure 7B:
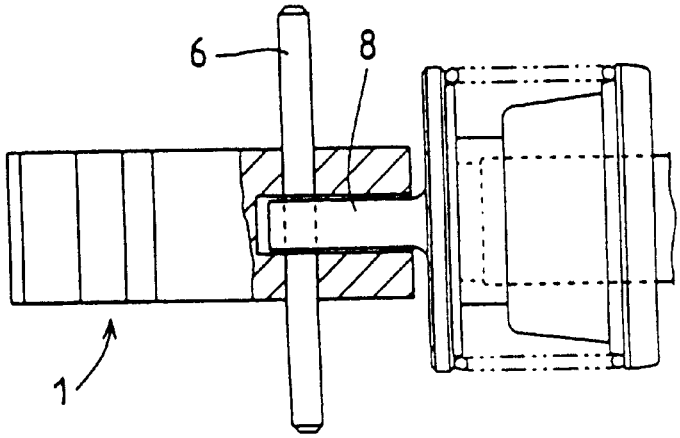
FIG. 7 (A) is a side view showing part of the driving cam 1 and the operating rod 8 used in the first embodiment of the present invention, and FIG. 7 (B) is the plan view.
Figure 7A:
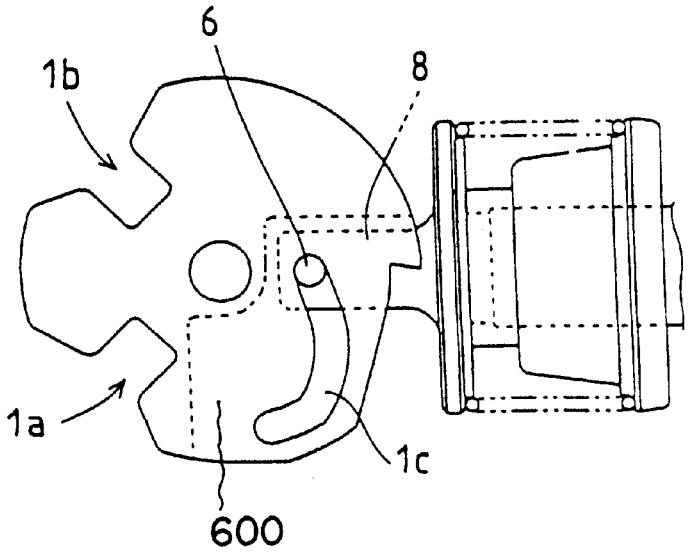
Figure 8:
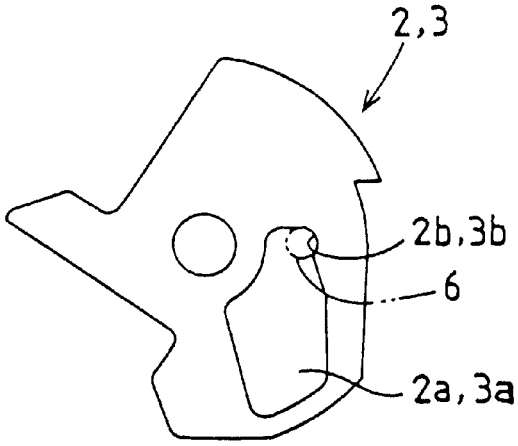
FIG. 8 is a side view showing the restricting plates 2, 3 used in the first embodiment of the present invention.

Referring now to FIG. 4 through FIG. 8, the mechanism of the operating portion of this embodiment will be described in detail hereinafter. FIG. 4 and FIG. 5 are a plan view and a side view, respectively, with the cover of the operating portion 111 removed. FIG. 6 is a center longitudinal sectional view of the operating portion 111. FIG. 7 (A) is a side view showing part of the driving cam 1 and the operating rod 8 fitted within a hollowed-out portion 600 in the driving cam 1, and FIG. 7 (B) is the plan view, while FIG. 8 is a side view extracting to show the restricting plates 2, 3.

To the center of the operating portion 111, a driving cam 1 is mounted. This driving cam 1 serves to provide displacement to the operating rod 8 of the switch portion 112, and is rotatably supported to the support frame 11 via a cam shaft 4.

Around the periphery of the driving cam 1, rectangular recesses 1*a*, 1*b* are formed in correspondence with the insertion holes 101*a* and 101*b* to which the pressurizing piece 121 of the actuator 102 fits in. To the driving cam 1, a groove cam 1*c* is formed at the position opposite to the recessed portions 1*a*, 1*b* with the cam shaft 4 placed in-between, and to this groove cam 1*c*, a cam follower pin 6 is inserted.

Both ends of the cam follower pin 6 extend to the vicinity of the support frame 11, and both end portions are supported by the guide grooves 7*a*, 7*a* of the pin guide member 7, respectively. Each of the guide grooves 7*a*, 7*a* serve to restrict the moving direction of the cam follower pin 6 to one direction, and is formed along the straight line which passes the center of the cam shaft and is parallel to the moving direction of the operating rod 8. To the cam follower pin 6, the end portion of the operating rod 8 is connected, and the connection contact of the switch portion 112 is changed over when the operating rod 8 advances and retracts as this cam follower pin 6 moves.

On the other hand, on both right and left sides of the driving cam 1, restricting plates 2, 3 are located, respectively. A pair of right and left restricting plates 2, 3 are members arranged in correspondence to the protruded portion pressurizing surfaces 121*b*, 121*b* of the actuator 102, and are rotatably supported to the cam shaft 4, respectively. Between these restricting plates 2, 3 and the support frame 11, torsion coil springs 5, 5 are mounted to return the restricting plates 2, 3 to the initial condition (position shown in FIG. 4 and FIG. 5), respectively. One end of this torsion coil spring 5, 5 is fixed to the support frame 11 and the other end to the restricting plates 2, 3.

To each of the restricting plates 2, 3, relief holes 2*a*, 3*a* of the cam follower pin 6 are formed, and at the edge portion of the holes 2*a*, 3*a*, notches 2*b*, 3*b* for restricting the move of the cam follower pin 6 are formed. Each of the notches 2*b*, 3*b* is machined in a semicircular profile to allow the cam follower pin 6 to fit in as shown in FIG. 8, and when each of the restricting plates 2, 3 is in the initial condition (condition shown in FIG. 5 and FIG. 6), the notches are located ahead of the moving direction of the cam follower pin 6 (see FIG. 9 (A)).

Under the above construction, the driving cam 1 and restricting plates 2, 3 are arranged in such positional relationship that generates a rotating phase difference between them that corresponds to the level difference between the recessed portion pressurizing surface 121*a* and the protruded portion pressurizing surface 121*b* of the actuator 102.

Figure 9:
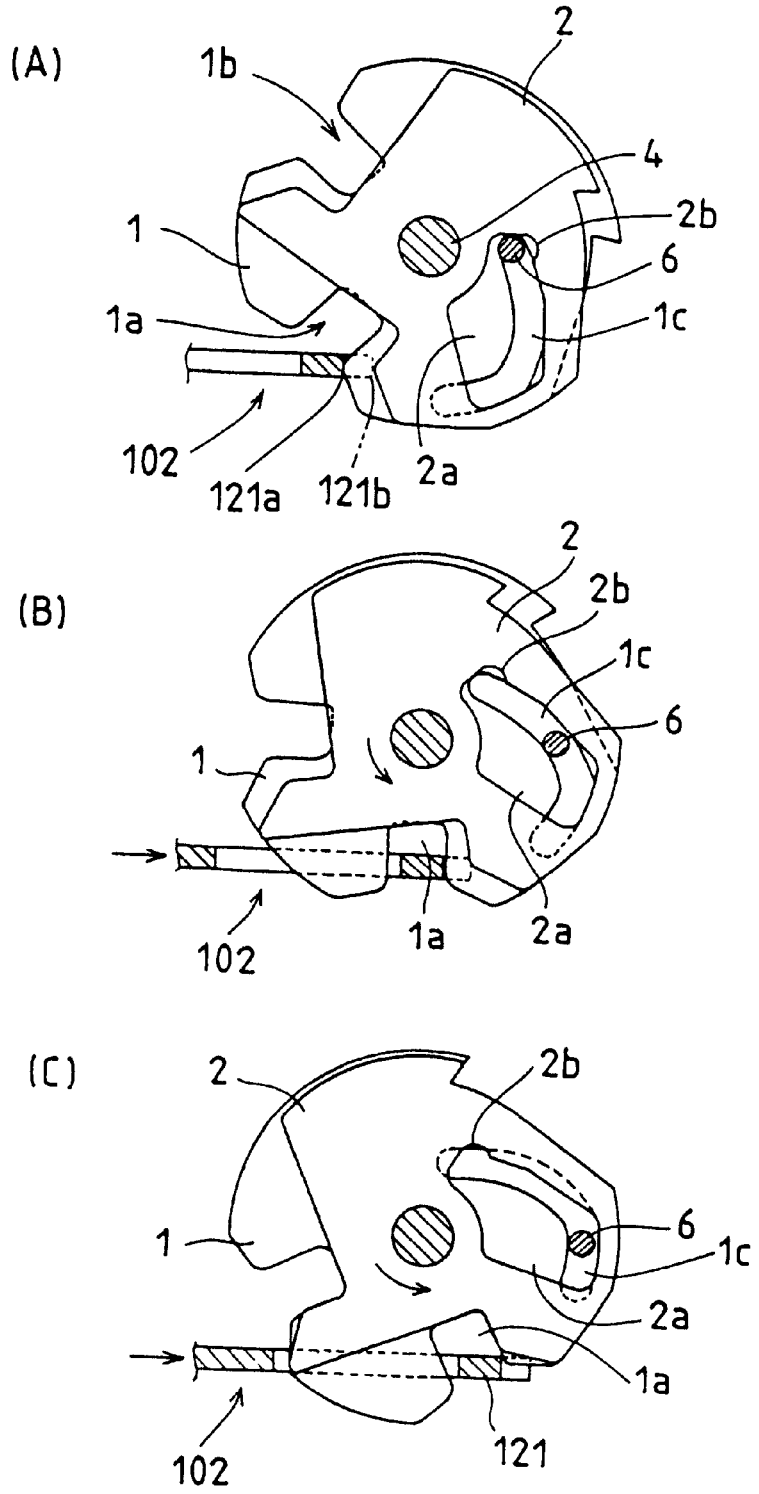
FIG. 9 (A), (B), (C) illustrate the operation of the first embodiment according to the present invention, respectively.

Next, referring to FIG. 9, the operation of the first embodiment according to the invention will be described. In FIG. 9, the restricting plate 3 located on the left side as seen from the insertion hole 101*a* side of the operating portion 111 does not appear in the figure and no reference character is designated, but since in this example, a pair of restricting plates 2 and 3 make the similar motion, they are designated to the restricting plates 2, 3 in the following description of operation.

When the actuator 102 enters the inside of the operating portion 111 through the insertion hole 101*a*, first of all, the recessed pressurizing surface 121*a* and the protruded pressurizing surfaces 121*b*, 121*b* at the tip end come in contact with the driving cam 1 and the restricting plates 2, 3, respectively (FIG. 9 (A)). At this point, the cam follower pin 6 does not move and is located on the end of the cam shaft 4 side of the groove cam 1*c* formed in the driving cam 1.

As the actuator 102 further advances, both the driving cam 1 and restricting plates 2, 3 rotate in response to this, and the cam follower pin 6 advances along the groove cam 1*c* and the operating rod 8 advances along with it, and at the same time, the notches 2*b*, 3*b* of the restricting plates 2, 3 come off from the moving path of the cam follower pin 6 [FIG. 9 (B)], and thereafter, the actuator 102 further advances and when it reaches the insertion end, the connection contact is changed over and at the same time the pressurizing piece 121 of the actuator 102 fits into the recessed portion la of the driving cam 1 as shown in FIG. 9 (C).

When each of the restricting plates 2, 3 rotates in the above operation, the torsion coil springs 5, 5 are twisted in the rotating direction, and with their elastic force, to each of the restricting plates 2, 3, the rotating force reversal to the former rotation (recovering force) is exerted.

When the actuator 102 is pulled out from the condition of FIG. 9 (C), the pressurizing piece 121 presses the inner surface of the recessed portion 1*a* and the driving cam 1 rotates reversibly to that at the time of insertion, and in response to this, the operating rod 8 retracts and the connection contact returns to the initial condition, and at the same time the recessed portion 1*a* of the driving cam 1 returns to the initial position, that is, the position of FIG. 9 (A), and each of the restricting plates 2, 3 returns to the initial condition by the elastic force of torsion coil springs 5, and notches 2*b*, 2*c* for pin engagement are located on the moving path of the cam follower pin 6.

In the above description of the operation, of the two insertion holes 101*a*, 101*b*, the operation when the actuator 102 is inserted into the insertion hole 101*a* provided on the front side of the operating portion 111 was described, but even when the actuator 102 is inserted into the insertion hole 101*b* on the top surface side of the operating portion 111, the driving cam 1 and the restricting plates 2, 3 rotate in the operation similar to that shown in FIG. 9 (A)–(C), and in response to this, the operating rod 8 advances to change over the connection contact and at the same time the pressurizing piece 121 of the actuator 102 fits into the recessed portion 1*b* of the driving cam 1.

Now, in the first embodiment of the present invention, even if an attempt is made to rotate the driving cam 1 using the pressurizing plate (for example, screwdriver, etc.) other than the special-purpose actuator 102, the rotation is prevented by the restricting plates 2, 3.

Figure 10:
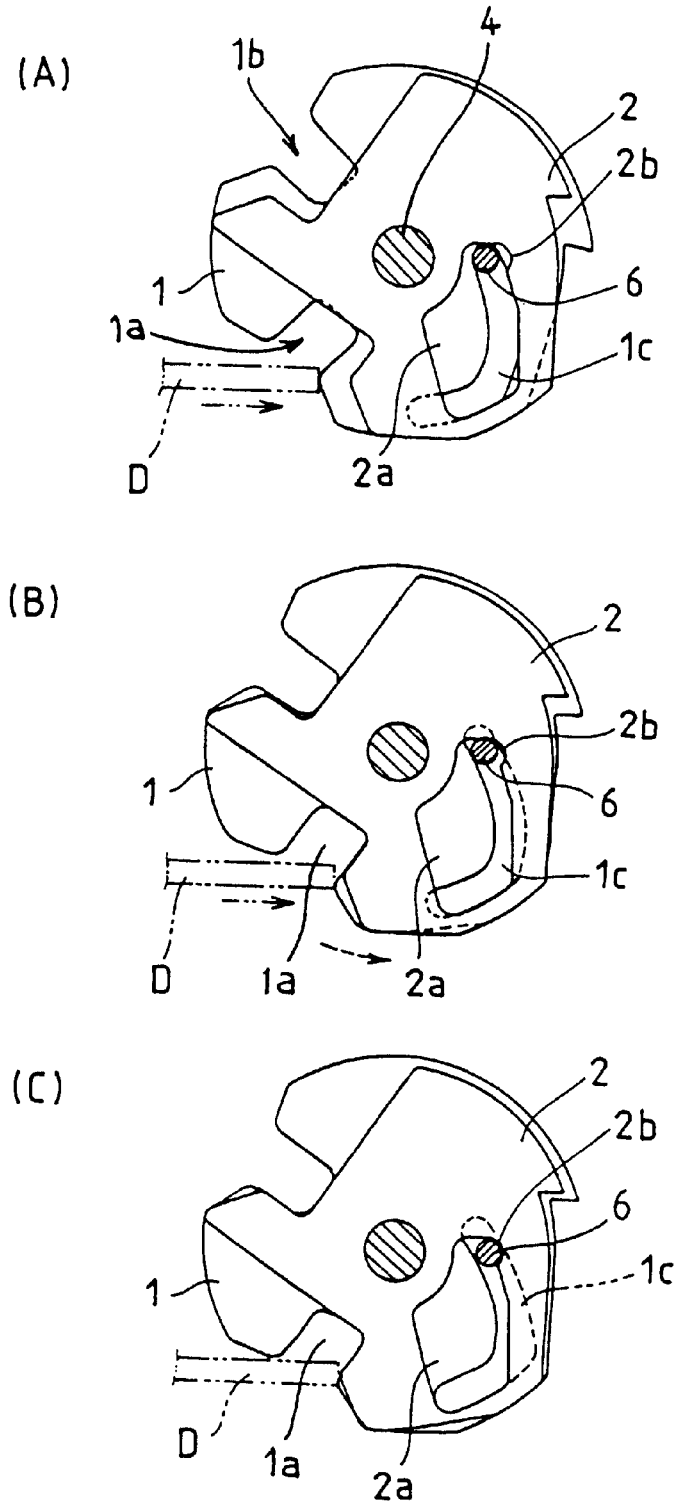
FIG. 10 (A), (B), (C) illustrate the operation of the first embodiment according to the present invention in which a pressurizing plate D other than the special-purpose actuator 102 is used, respectively.

That is, as shown in FIG. 10, pressing the recessed portion 1*a* (or 1*b*) of the driving cam 1 by inserting the pressurizing plate D into the center portion of the insertion hole 101*a* (or 101*b*) [FIG. 10 (A)] slightly rotates the driving cam 1 [FIG. 10 (B)] but when the pressurizing plate D reaches the vicinity of the restricting plates 2, 3, as shown in [FIG. 10 (C)], the movement of the cam follower pin 6 in the forward direction is restricted by the notches 2*b*, 3*b* of the restricting plates 2, 3, and at the same time, the movement in the rotating direction is restricted because the cam follower pin 6 is supported by the guide grooves 7*a* of the guide member 7, and the movement of the cam follower pin 6 in the forward direction and in the rotating direction is restricted, and the rotation of the driving cam 1 is thereby blocked.

Figure 11:
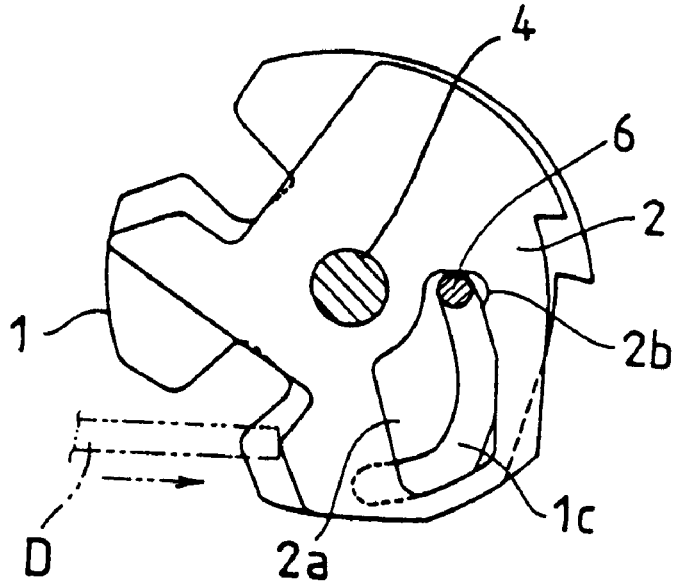
FIG. 11 (A), (B) illustrate the operation of the first embodiment according to the present invention in which a pressurizing plate D is used.
Figure 11:
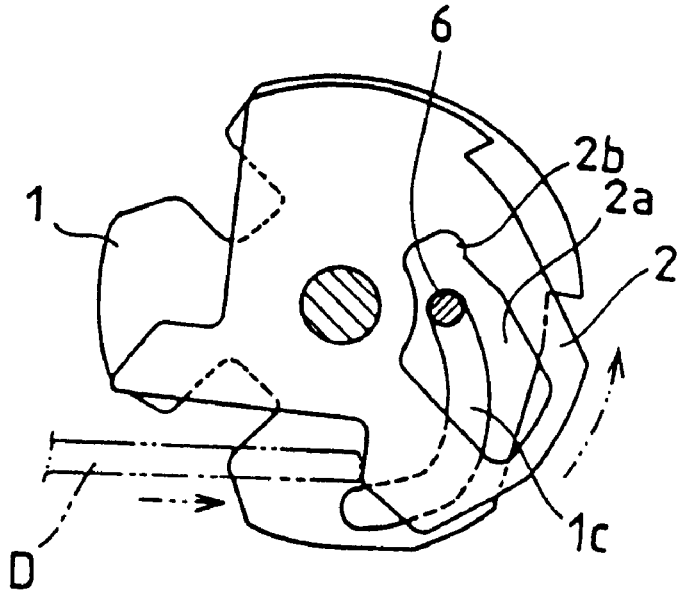

In addition, if one or both or either of the restricting plates 2, 3 are rotated using the pressurizing plate D, the driving cam 1 will not rotate. That is, as shown in FIG. 11, when the driving cam 1 and the restricting plates 2, 3 are in the initial condition shown in FIG. 11 (A), the cam follower pin 6 is located at the position free of interference with the notches 2*b*, 3*b* of the restricting plates 2, 3, and even if the restricting plates 2, 3 are pressed to rotate by the pressurizing plate D, the restricting plates 2, 3 only rotate as shown in FIG. 11 (B), and the driving cam 1 is free of application of any force and is held to a standstill.

Figure 12:
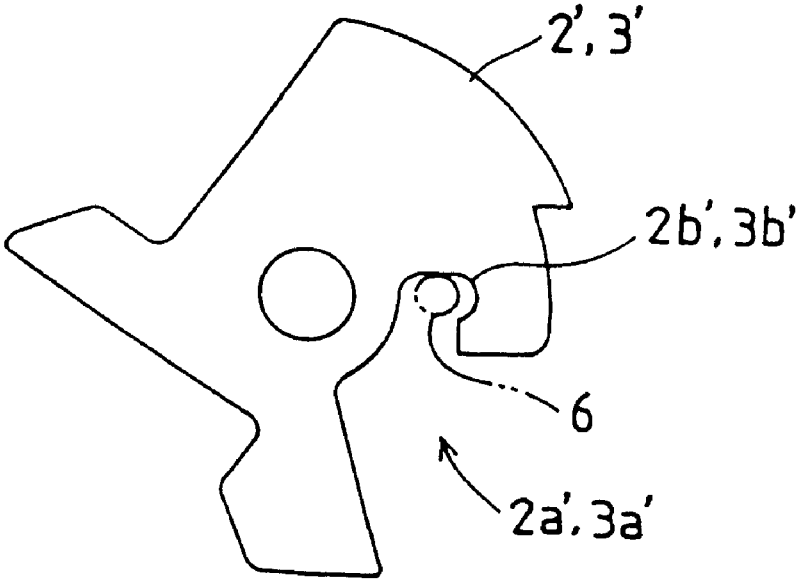
FIG. 12 is a side view showing a deformation example of the restricting plate used for the safety switch of the present invention.

In the above embodiment, a configuration in which relief holes 2*a*, 3*a* are provided on each of the restricting plates 2, 3 to avoid interference with the cam follower pin 6 is employed, but in addition to this, as illustrated in FIG. 12, opening recesses 2*a*', 3*a*' may be provided on the restricting plates 2', 3' to avoid interference with the cam follower pin 6.

In the above embodiments, the movement of the cam follower pin 6 is restricted by notches 2*b*, 3*b*, but this invention shall not be restricted to this, but for example, an engaging piece in the form of hook or key (L-letter shape) the cam follower pin 6 hitches may be formed integrally to the restricting plates, or any other optional construction may be adopted as long as it comes in contact with the cam follower pin 6 and can restrict its move.

In addition, in the above embodiments, as a means for returning the restricting plates 2, 3 to the initial condition, an example of using torsion coil spring 5 was shown, but in addition to this, generally applied elastic members such as tension coil springs or plate springs may be applied.

Figure 13:
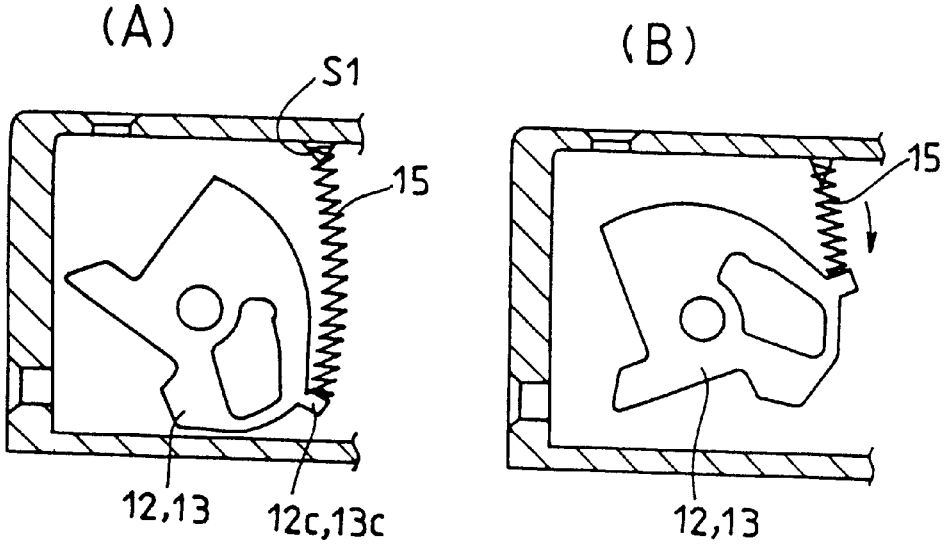
FIG. 13 (A), (B) illustrate the operation of the first embodiment according to the present invention in which a compression coil spring is used for an elastic member, respectively.

When the compression coil spring is used, for example, as shown in FIG. 13 (A), engaging pieces 12*c*, 13*c* are installed to the restricting plates 12, 13, and between this engaging piece 12*c*, 13*c* and the engaging portion S1 installed on the cover side, a compression coil spring 15 is inserted, and by the compression coil spring 15 which is compressed by the rotation of the restricting plates 12, 13, the restoring force to the initial condition can be obtained as shown in FIG. 13 (B).

Figure 14:
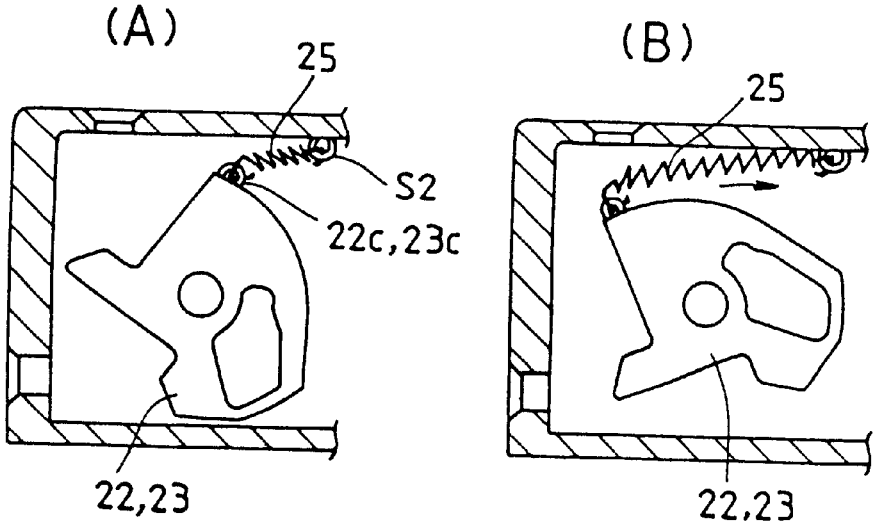
FIG. 14 (A), (B) illustrate the operation of the first embodiment according to the present invention in which a tension coil spring is used for an elastic member, respectively.

When the tension coil spring is used, for example, as shown in FIG. 14 (A), to the restricting plates 22, 23, engaging portions 22*c*, 23*c* one end of the hook of the tension coil spring 25 hitches are installed, and an engaging portion S2 the other end of the hook hitches is installed on the cover side, and as shown in FIG. (B), the tension coil spring 25 is designed to be pulled when the restricting plates 22, 23 rotate.

Figure 15:
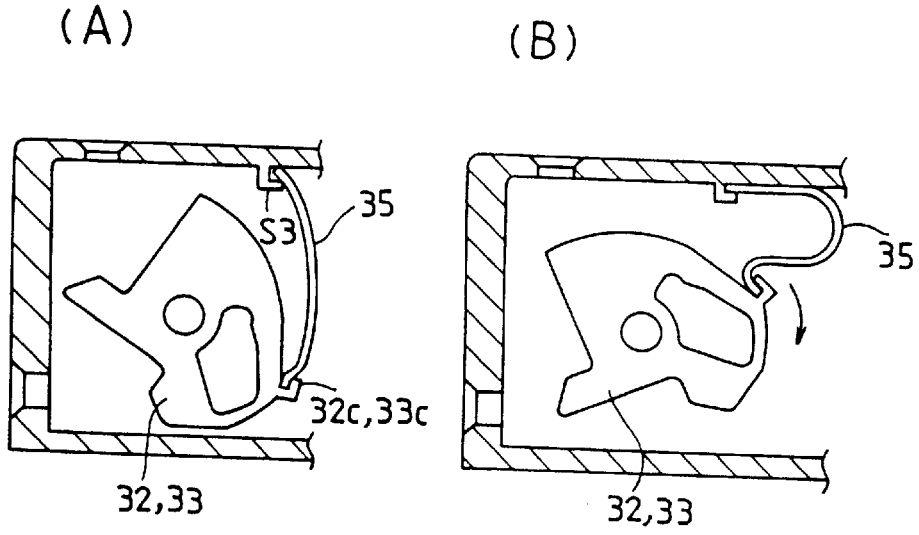
FIG. 15 (A), (B) illustrate the operation of the first embodiment according to the present invention in which a plate coil spring is used for an elastic member, respectively.

In addition, when the plate spring is used, as shown in FIG. 15 (A), engaging pieces 32*c*, 33*c* are provided on the restricting plates 32, 33, and between this engaging piece 32*c*, 33*c* and the engaging piece S3 located on the cover side, the plate spring 35 is inserted, and the plate spring 35 deflects nearly in a U-letter shape by the rotation of the restricting plates 32, 33 to provide the recovering force as shown in FIG. 15 (B).

Figure 16:
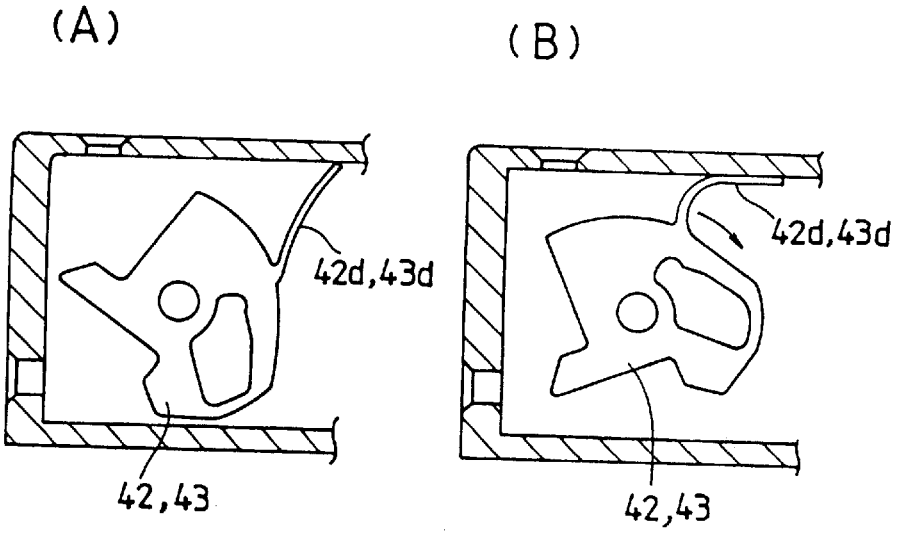
FIG. 16 (A), (B) illustrate the operation of the first embodiment according to the present invention in which a plate coil spring and the restricting plate are integrally formed, respectively.

As the other example using the plate spring, as shown in FIG. 16 (A), a configuration may be adopted, in which plates springs 42*d*, 43*d* are formed integrally to the restricting plates 42, 43, and the recovering force can be obtained by allowing this plate springs 42*d*, 43*d* to deflect as shown in FIG. 16 (B).

Figure 17:
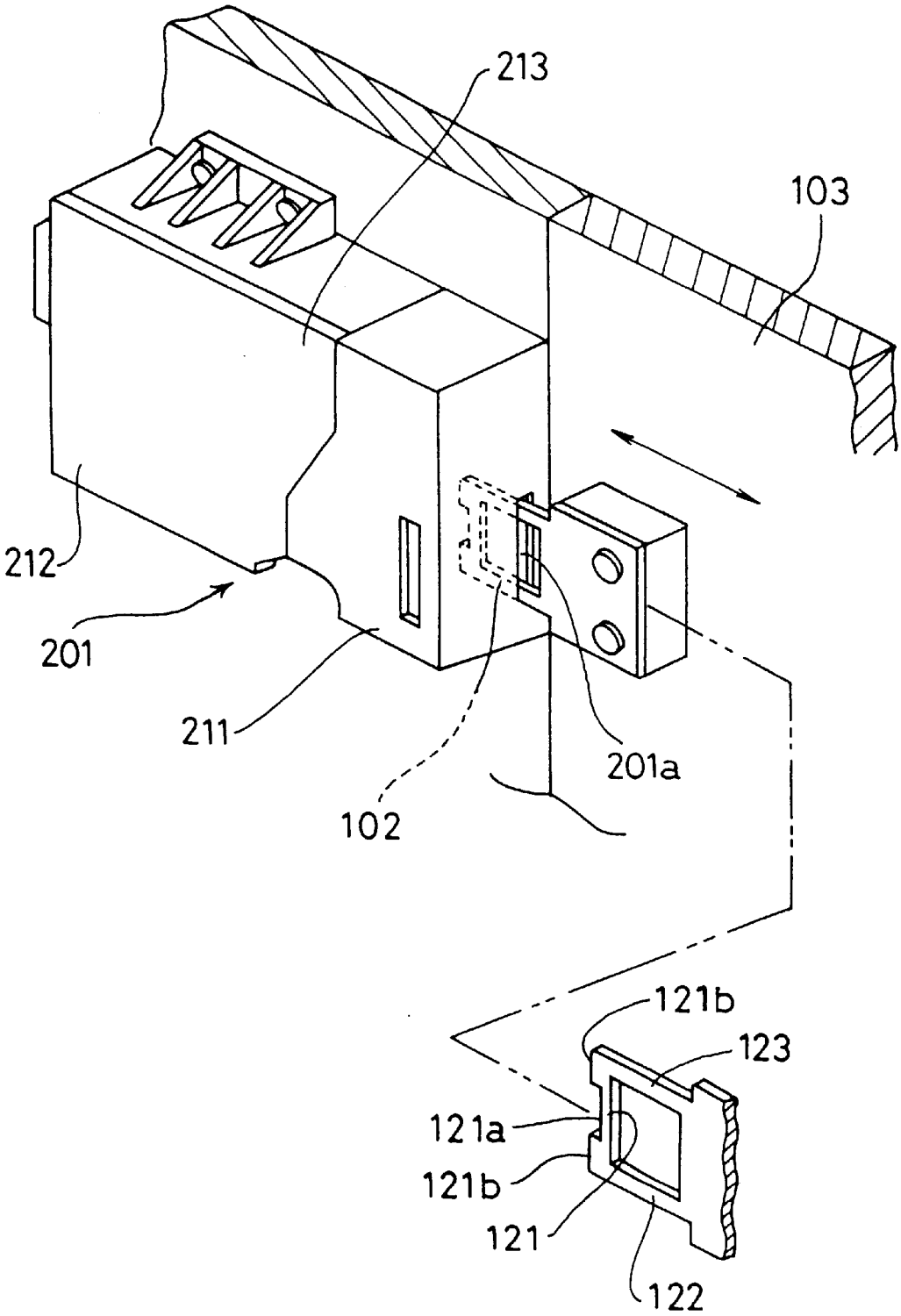
FIG. 17 is a perspective view of a second embodiment of the present invention under the applied condition.
Figure 18:
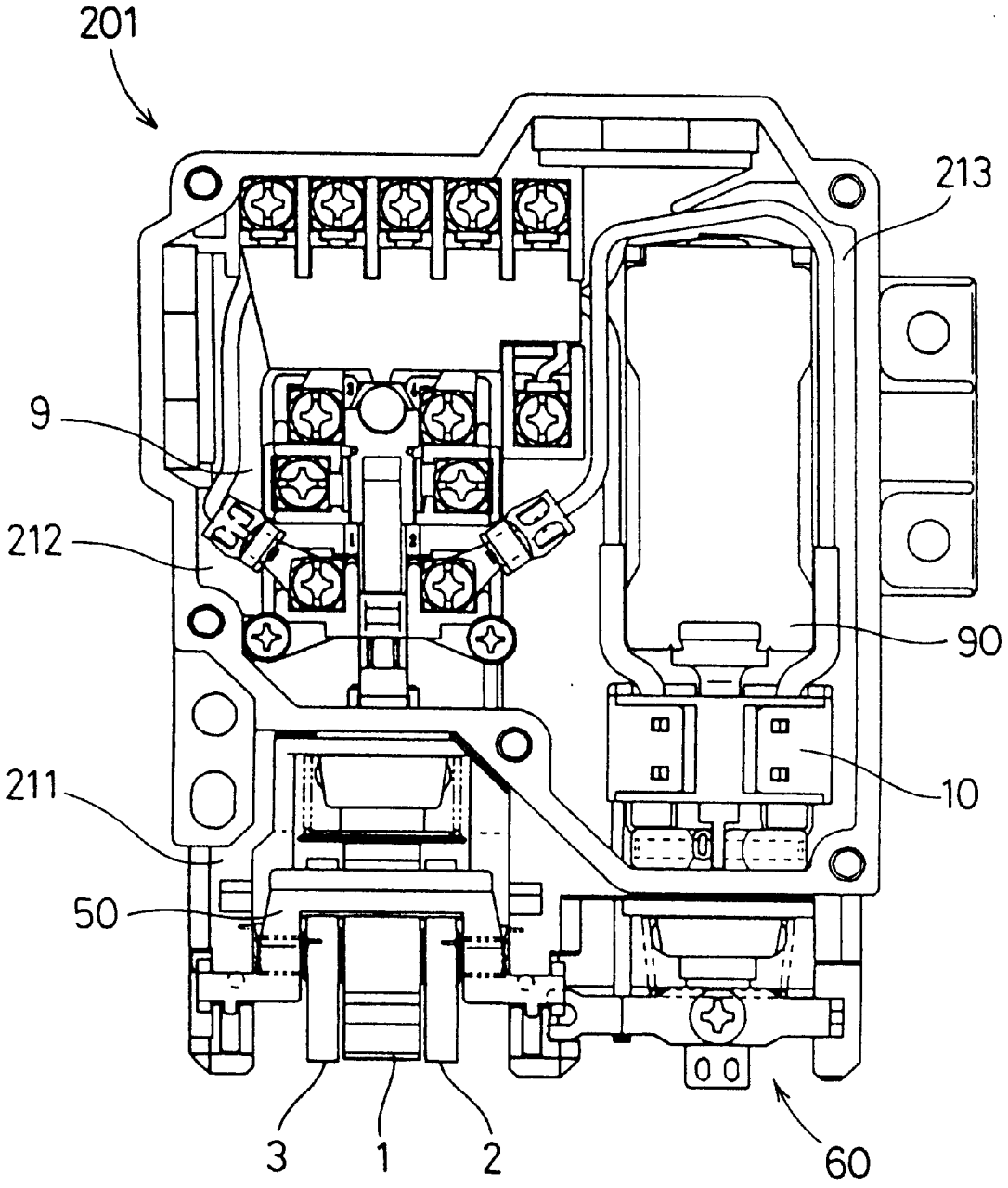
FIG. 18 is a plan view showing a configuration of a second embodiment of the present invention with a cover removed.
Figure 19:
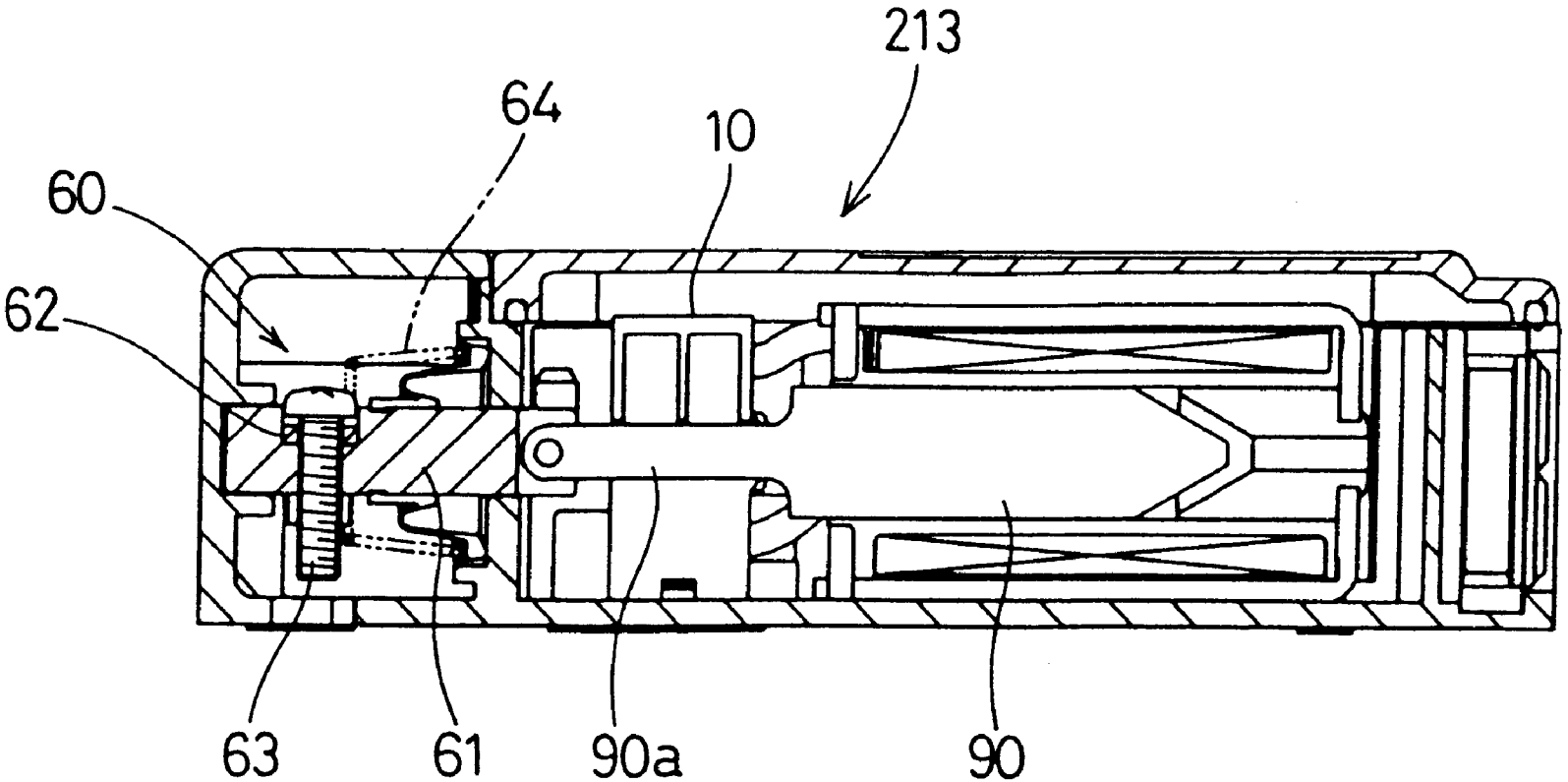
FIG. 19 is a side view showing a configuration of a second embodiment of the present invention with a cover removed.
Figure 20:
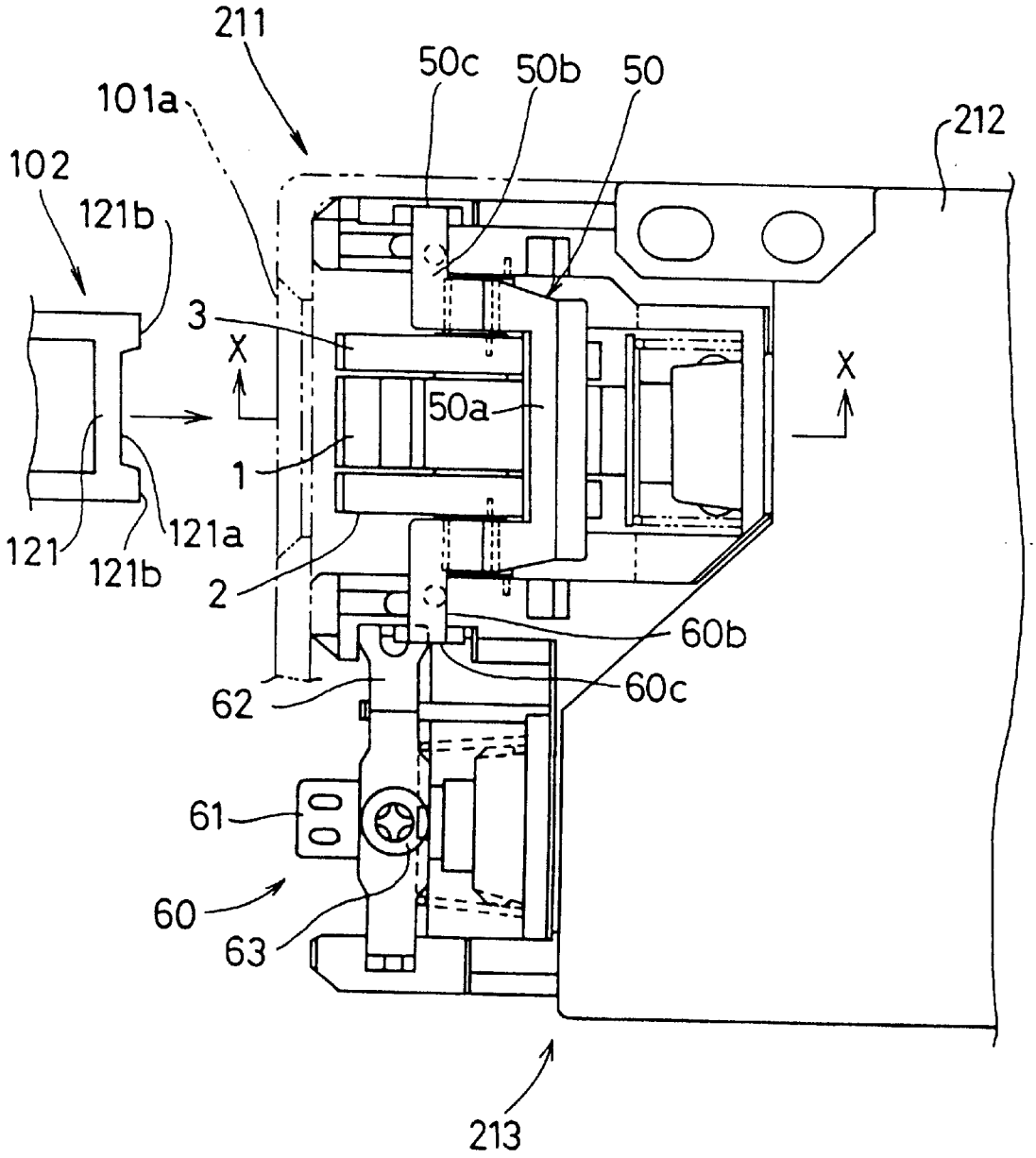
FIG. 20 is a plan view showing a configuration of the operating portion 211 and the solenoid mechanism portion 213 of a second embodiment of the present invention with a cover removed.
Figure 21:
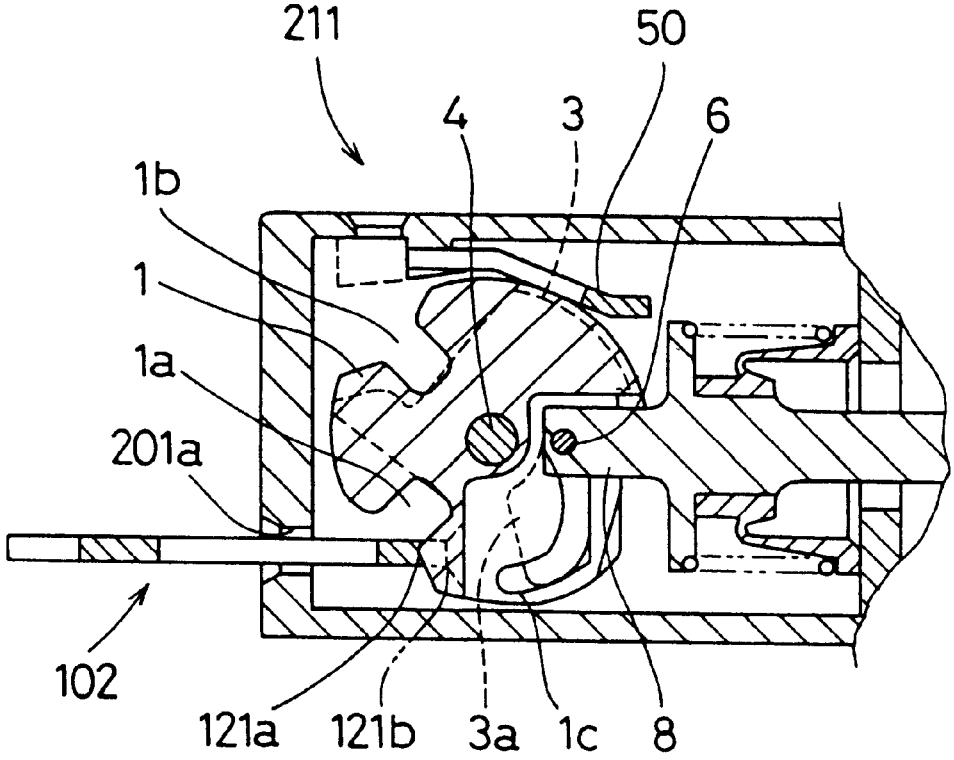
FIG. 21 is a cross-sectional view taken on the lines X—X of FIG. 20.

FIG. 17 is a perspective showing the application condition of a second embodiment of the present invention, FIG. 18 and FIG. 19 are block diagrams of the second embodiment, which are a plan view and a side view with the cover removed, respectively. FIG. 20 is a plan view showing the operating portion 211 and the solenoid mechanism portion 213 with the cover removed, and FIG. 21 is a cross-sectional view taken on line X—X of FIG. 20.

To the operating portion 211, the driving cam 1 that rotates in response to the advance and retraction of the actuator 102, restricting plates 2, 3 rotatably supported to the cam shaft 4 of the driving cam 1, and the groove cam 1*c* of the driving cam 1 are inserted in the same manner as in the case of the previous embodiment, in which the cam follower pin 6 connected to the end portion of the operating rod 8, torsion coil springs 5, 5, etc. for returning each of the restricting plates 2, 3 to the initial condition are installed.

Now, in this embodiment, on the circumferential surface of the driving cam 1, a lock stepped portion 1*d* (see FIG. 22) is formed, and at the location above the driving cam 1 and the restricting plates 2, 3, a lock lever 50 is placed.

The lock lever 50 is a member with the engaging piece 50*a*, arm 50*b* supporting both ends, and operating piece 50*c* supporting the arm ends integrally formed, and is constructed to enable the engaging piece 50*a* to come in contact as pressed against the exterior circumferential surface of the driving cam 1 by the elastic force of the compression coil springs 51, 52 placed at two places, right and left, respectively.

On the other hand, the solenoid mechanism portion 213 is equipped with a lock canceling mechanism 60 for canceling the lock mechanism (lock lever 50) of the operating portion 211 and a solenoid 90 for generating the canceling force.

The lock canceling mechanism 60 comprises an operating rod 61 connected to the tip end portion of the plunger 90*a* of the solenoid 90, an operating plate 62 securely fixed to the tip end portion of the rod 61 with a machine screw 63, and a compression coil spring 64, etc. The end portion on the side of the operating portion 211 of the operating plate 62 comes in contact with the front side of the lower end portion of the operating piece 50*c* of the lock lever 50, and in response to the movement of this operating plate 62, the lock lever 50 is constructed to swing.

To the solenoid mechanism portion 213, a microswitch 10 that opens and closes in response to the move of the plunger 90*a* of the solenoid 90 is installed. This microswitch 10 is a switch that is normally closed and opens when the solenoid 90 is excited, and as shown in the circuit block diagram of FIG. 23 (A), (B), (C), is connected to the main circuit (power supply feed circuit to the industrial machinery) to which connection contacts of the contact block 9 on the switch portion side to be in series to the connection contact.

Figure 22:
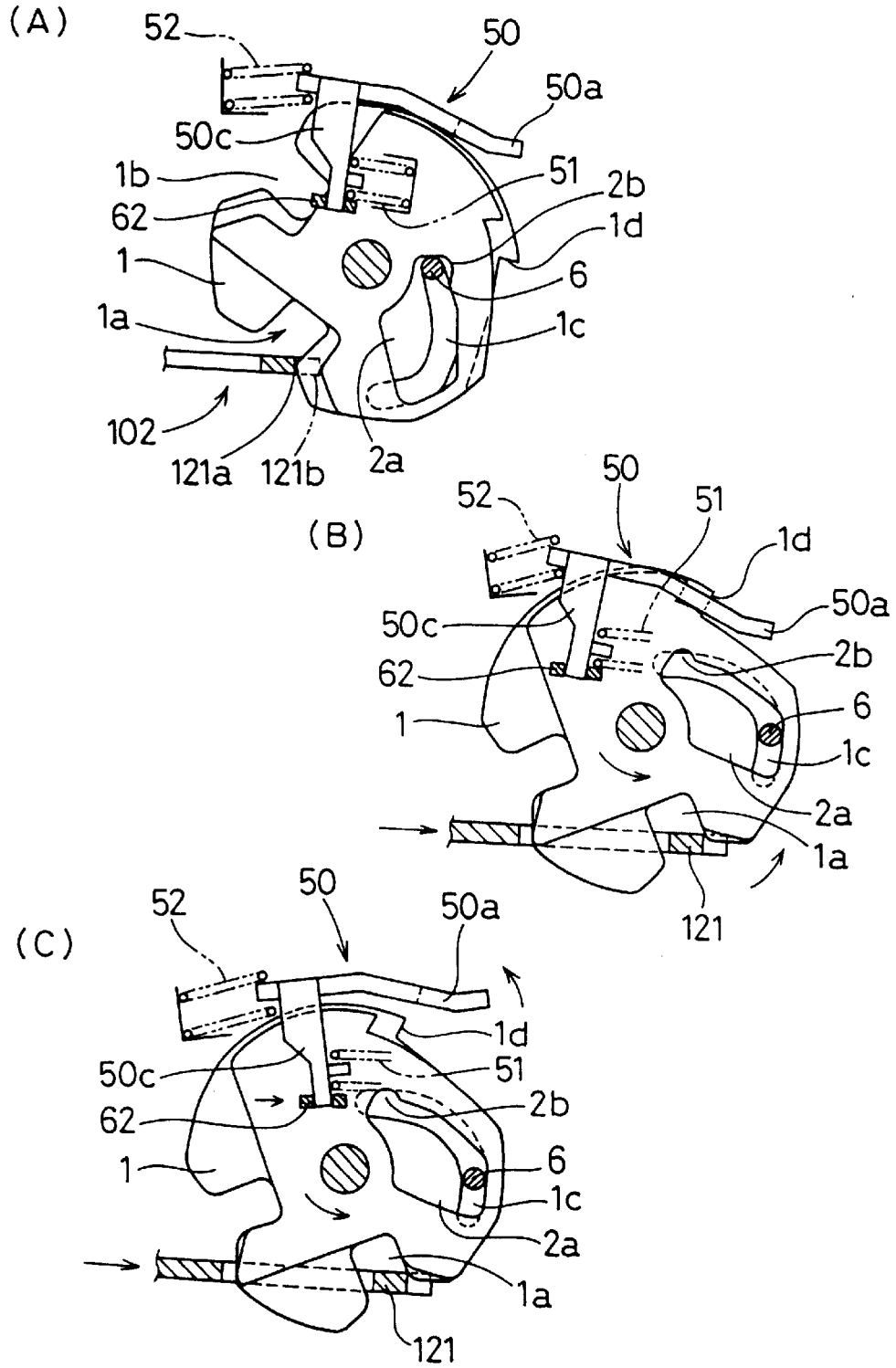
FIG. 22 (A), (B), (C) illustrate the operation of a second embodiment according to the present invention, respectively.

The operation of the second embodiment of the invention of the above configuration is described referring to FIGS. 22(A)–22(C). As the actuator 102 advances the inside of the operating portion 211 through the insertion hole 201*a*, first of all, the recessed portion pressurizing surface 121*a* and the protruded portion pressurizing surfaces 121*b*, 121*b* at the tip end come in contact with the driving cam 1 and the restricting plates 2, 3, respectively [FIG. 22 (A)]. In this event, the cam follower pin 6 does not move and is located at the end on the cam shaft 4 side of the groove cam 1*c* of the driving cam 1.

As the actuator 102 further advances, both the driving cam 1 and restricting plated 2, 3 rotate in response to this, and the cam follower pin 6 advances along the groove cam 1*c* and the operating rod 8 advances along with it, and at the same time, the notches 2*b*, 3*b* of the restricting plates 2, 3 come off from the moving path of the cam follower pin 6, and thereafter, the actuator 102 further advances and when it reaches the insertion end, the connection contact is changed over and at the same time the pressurizing piece 121 of the actuator 102 fits into the recessed portion la of the driving cam 1 as shown in FIG. 22 (B).

In this event, the engaging piece 50*a* of the lock lever 50 displaces to the position to hitch the lock stepped portion 1*d* of the driving cam 1 by the pressurizing force of the compression coil springs 51, 52, and the rotation in the returning direction (clockwise) of the driving cam 1 is blocked by this. Consequently, even when the force in the pulling out direction is exerted to the actuator 102 to open the door 103, the pressurizing piece 121 hitches the recessed portion la of the driving cam 1 under the rotation blocking state and pull-out of the actuator 102 is prevented.

On the other hand, when the solenoid mechanism portion 213 operates in response to the operation OFF signal when the power supply to the machine is interrupted, the plunger

90*a* of the solenoid 90 retracts and the operating plate 62 of the lock canceling mechanism 60 moves. By the movement of this operating plate 62, as shown in FIG. 22 (C), the engaging piece 50*a* side of the lock lever 50 is lifted up, and the lock stepped portion 1*d* of the driving cam 1 of the engaging piece 50*a* disengages from the lock stepped portion 1*d* of the driving cam 1, and by this, the rotation blocking of the driving cam 1, that is, mechanical lock of the actuator 102, is canceled, bringing the door 103 to be ready for opening.

Figure 23:
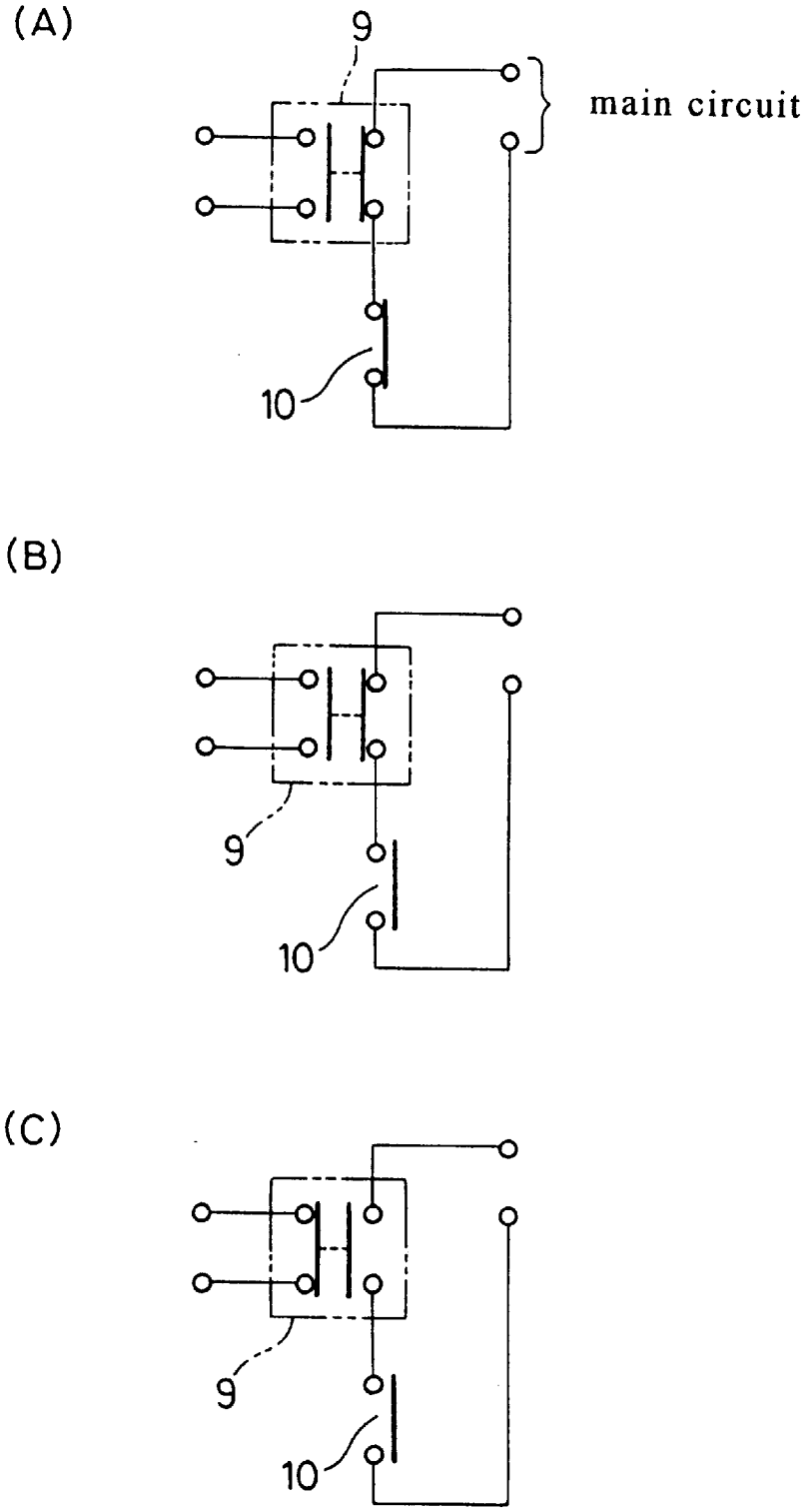
FIG. 23 (A) is a circuit block diagram where the door is closed, FIG. 22 (B) a circuit block diagram where the lock is canceled, and FIG. 22 (C) a circuit block diagram where the door is closed in a second embodiment of the present invention, respectively.

When the solenoid mechanism portion 213 operates in response to the operation OFF signal, if the microswitch 10 (normally closed) installed to this solenoid mechanism portion 213 is "OPEN" before the door 103 is opened to interrupt the main circuit (power supply feed circuit to the industrial machinery) [FIG. 23 (B)], and thereafter, the door 103 is opened and the actuator 102 is pulled out from the operating portion 211, the operating rod 8 retracts in response to this and the connection contact of the contact block 9 returns to the initial state [FIG. 23 (C)].

Figure 24:
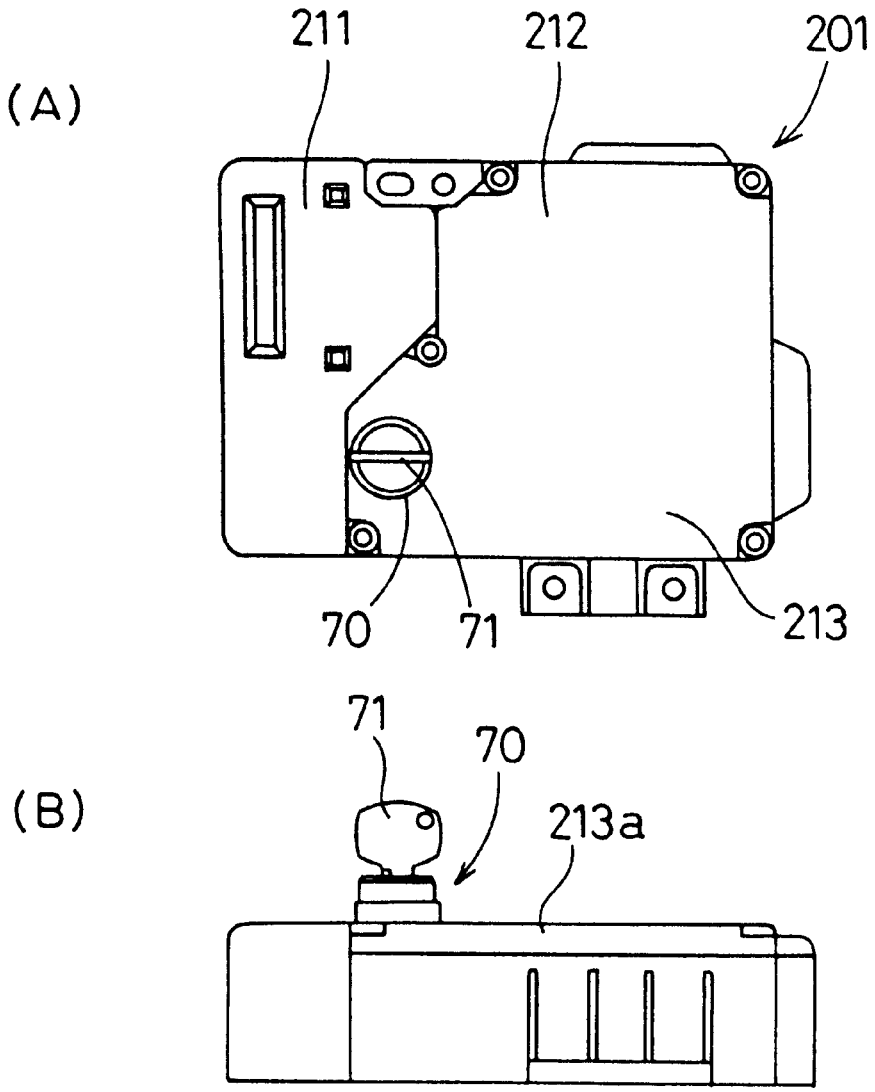
FIG. 24 (A) is a plan view of a third embodiment according to the present invention and FIG. 24 (B) the side view.
Figure 25:
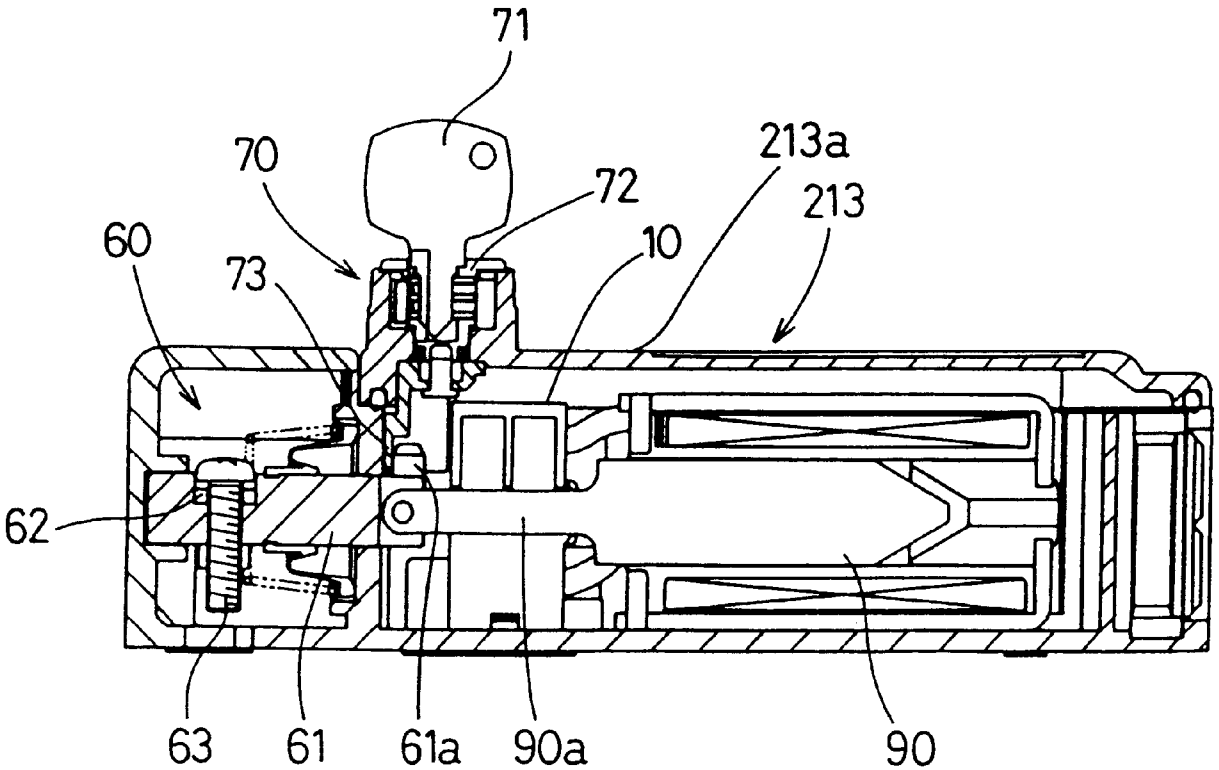
FIG. 25 is a longitudinal cross sectional view of a third embodiment according to the present invention.

FIG. 24 (A) is a plan view of a third embodiment of the present invention, FIG. 24 (B) the side view, and FIG. 25 a longitudinal cross sectional view of the third embodiment.

This embodiment is characterized by the key operating portion 70 installed to the top cover 213*a* of the solenoid mechanism portion 213 in the safety switch (with lock mechanism) of the construction shown in FIG. 17–FIG. 22.

The key operating portion 70 comprises a rotating member 72 that rotates in response to the insertion and rotation of a specific key 71 and a cam 73 securely fixed to its lower end portion.

Figure 26:
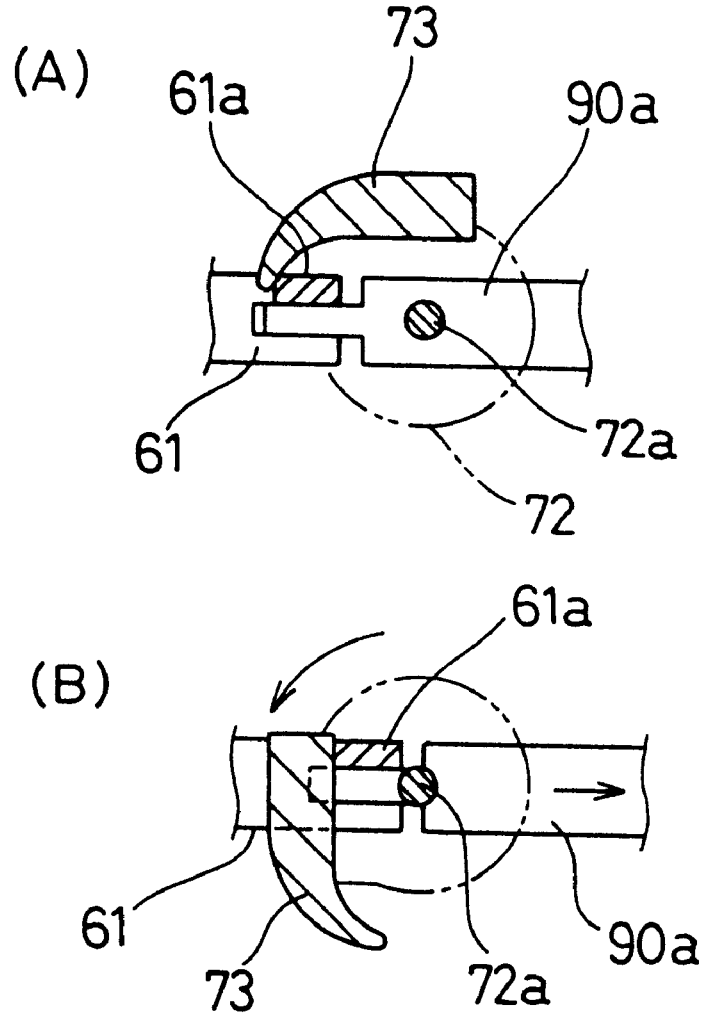
FIG. 26 (A), (B) illustrate operation of a third embodiment of the present invention.

The cam 73 is a member whose inner surface is machined to a specified radius as shown in FIG. 26, and it is configured in such a manner that to the inner surface of the cam 73, a cam follower pin 61*a* installed to the rear end portion (tip end portion of the plunger 90*a* of the solenoid) of the operating rod 61 of the lock canceling mechanism comes in contact, and as the rotating member 72 rotates by the key operation, the cam 73 rotates around the center axis 72*a* of the rotating member 72 to move the operating rod 61.

FIG. 26 (A) shows the locked condition of the actuator 102 and FIG. 26 (B) the lock canceled condition thereof.

If the key operating portion 70 of the above construction is installed, it is possible to manually cancel the lock without operating the solenoid 90 in time of power failure, during maintenance, etc. In addition, because the lock mechanism is unable to be canceled by anything other than the special-purpose key, there occurs no such inconvenience that the lock is canceled mistakenly during operation of the industrial machinery, etc. in the room.

Figure 27:
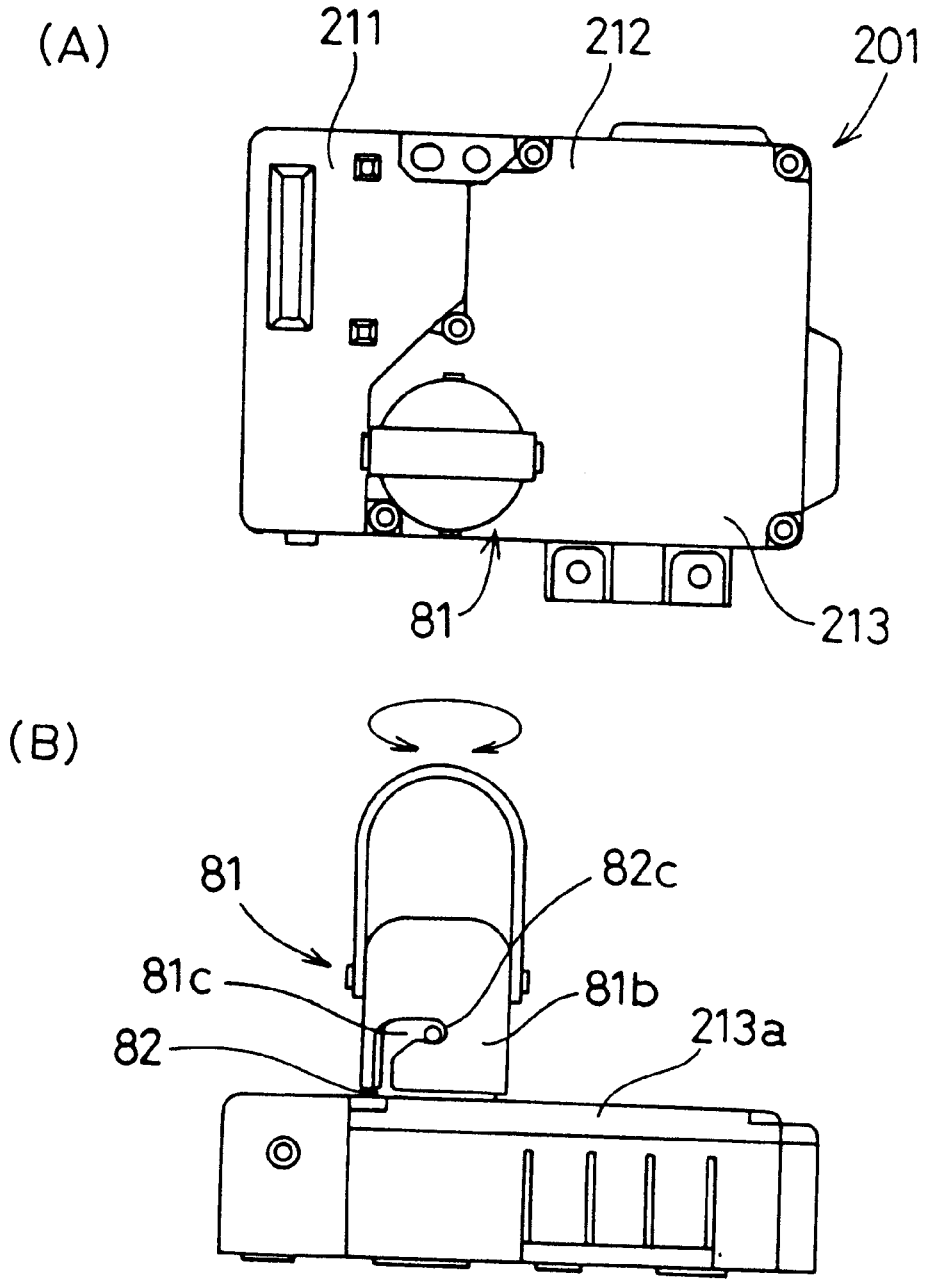
FIG. 27 (A) is a plan view of a fourth embodiment according to the present invention and FIG. 27 (B) the side view.
Figure 28:
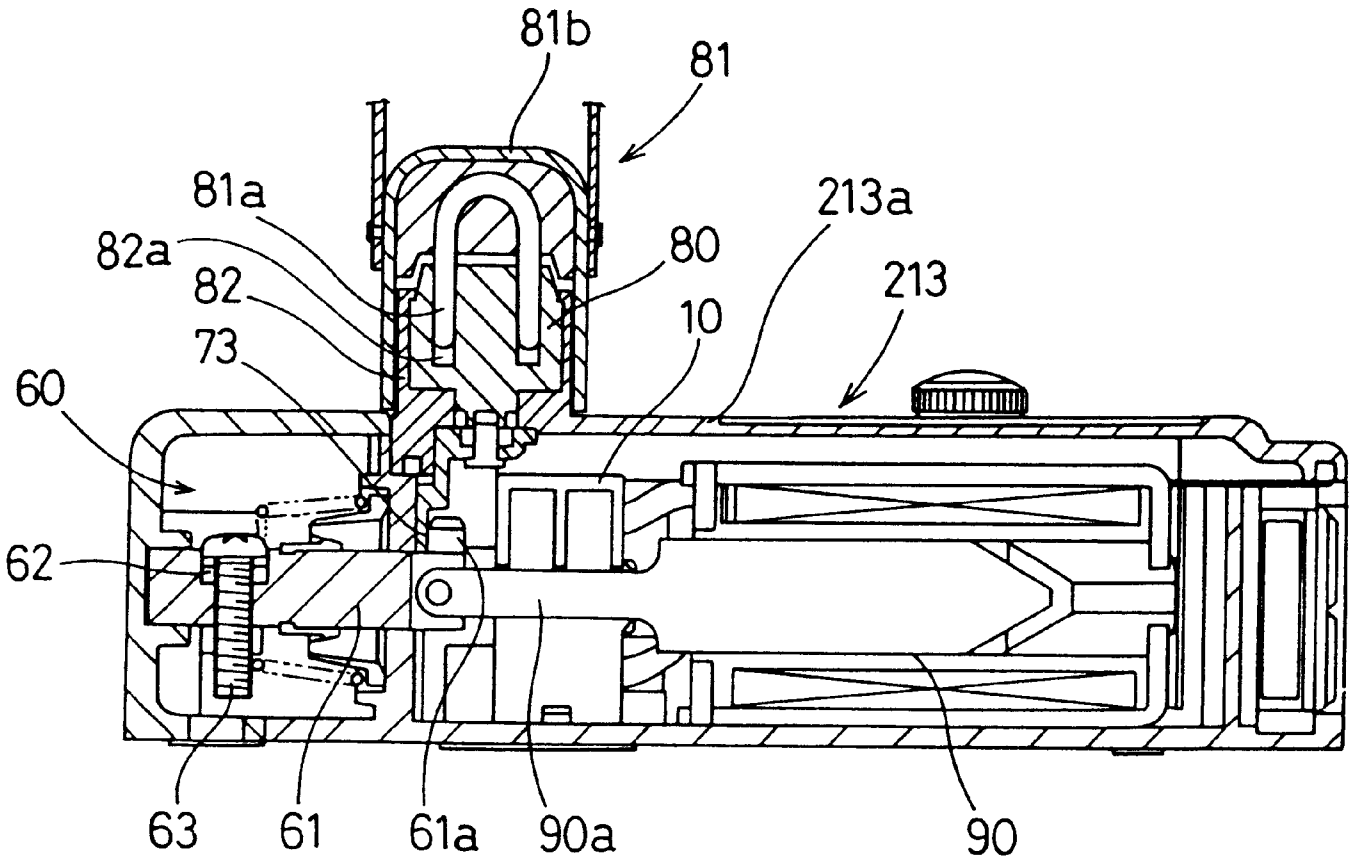
FIG. 28 is a longitudinal cross sectional view of a fourth embodiment according to the present invention.

FIG. 27 (A) is a plan view of a fourth embodiment of the present invention, FIG. 27 (B) the side view, and FIG. 28 the longitudinal cross-sectional view of the fourth embodiment.

The fourth embodiment is characterized by integrally installing the cylindrical form receiving seat 8 to the top cover 213*a* of the solenoid mechanism portion 213 and inserting and arranging the plug receiver 80 to this receiving seat 82 in the safety switch (with lock mechanism) of the construction shown in FIG. 17–FIG. 22.

The plug receiver 80 is a member in which the pin insertion hole 82*a* for inserting the pin 81*a* of the insertion plug 81 later described is installed at the position opposite to each other with the center in-between, and is rotatably placed with the cylindrical shaft as a center in the receiving seat 82, and to the lower end portion of this plug receiver 80, the cam 73 is securely fixed.

The cam 73 has the same profile as that shown in FIG. 26, to the inner surface of which the cam follower pin 61*a* installed to the operating rod 61 of the lock canceling mechanism is in contact, and is constructed to rotate in response to the rotation of the plug receiver 80 by the plug operation (see FIG. 26) to move the operating rod 61.

The insertion plug 81 comprises a plug frame 81*b* and a pin 81*a* integrally installed to this as shown in FIG. 28.

The plug frame 81*b* is removable attached to the receiving seat 82 by the so-called bayonet joint construction, which comprises a protrusion 82*c* provided to the receiving seat 82 and a groove 81*c* that fits into this, and is mounted by the insertion and rotation of the receiving seat 82 and is removed from the receiving seat 82 in the reverse procedure as shown in FIG. 27 (B).

In the embodiment of the above construction, rotating (counterclockwise) the insertion plug 81 as fitted to the receiving seat 82 rotates the plug receiver 80, causes the cam 73 to rotate in response to this, and the operating rod 61 moves.

Consequently, in the fourth embodiment, it becomes possible to cancel the lock manually without operating the solenoid 90. In addition, since the lock is unable to be canceled with anything other than the special-purpose insertion plug, there occurs no such inconvenience that the lock is canceled mistakenly while the industrial machinery, etc. is in operation in the room.

The manual lock canceling means by the key operation or plug operation as described above may be installed independently to the switch proper 201 without combining the solenoid 90.

Figure 29:
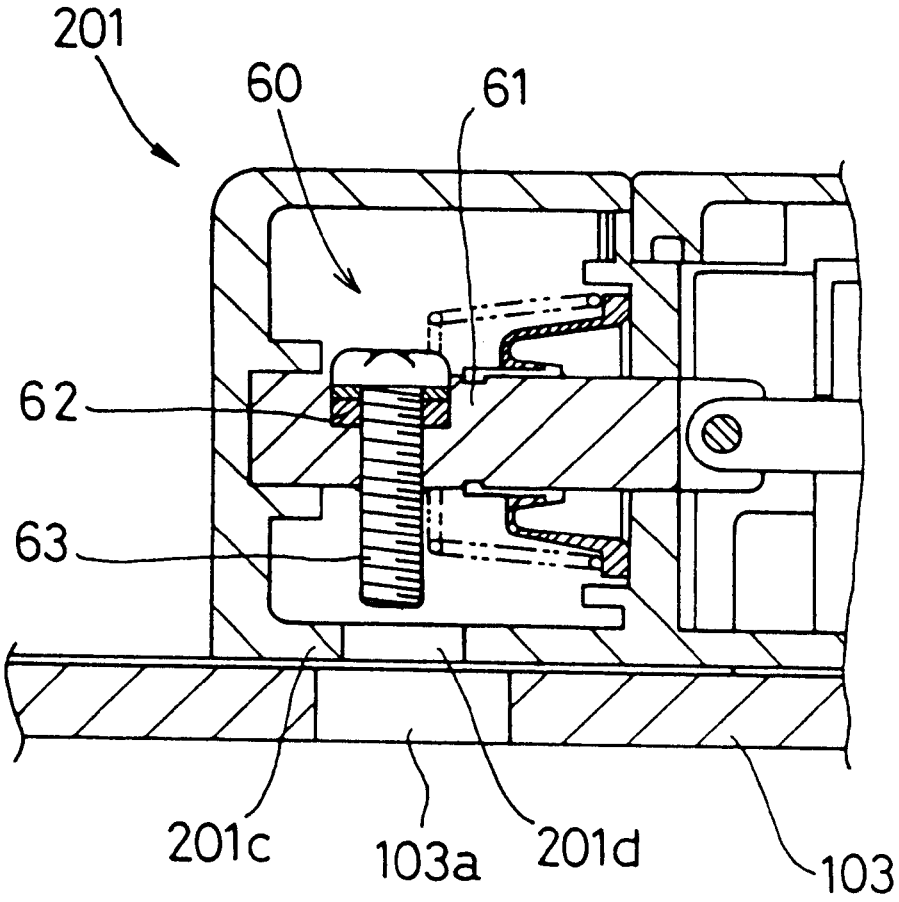
FIG. 29 illustrates another example of a means for manually canceling the lock mechanism of the actuator.
Figure 30:
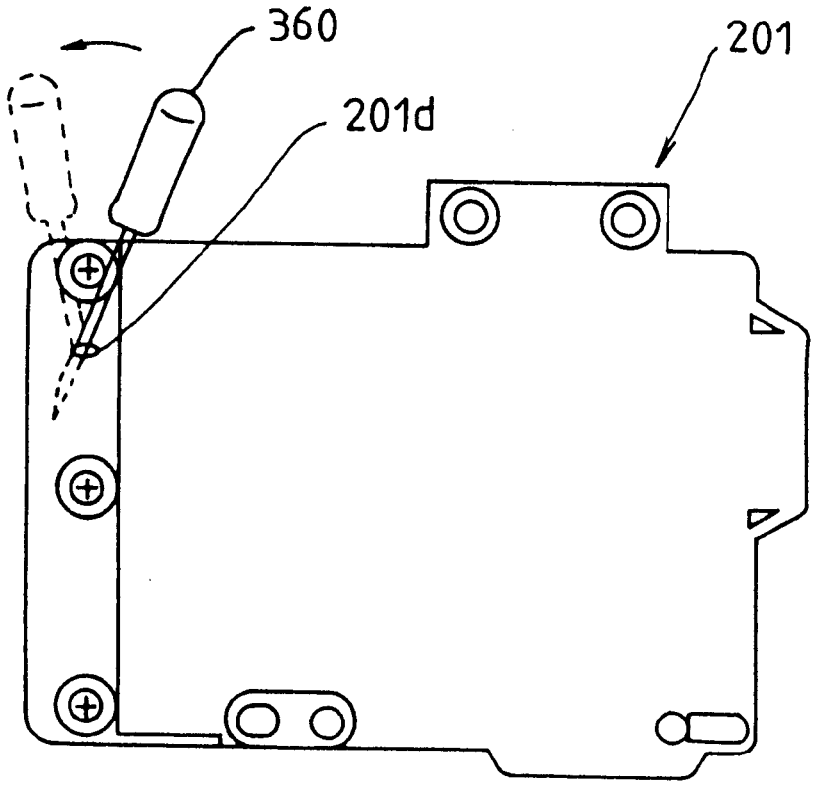
FIG. 30 illustrates an operation of the example in FIG. 29.

Now, in each of the embodiments of FIG. 19, FIG. 25, or FIG. 28, because the end portion of the machine screw 63 to be securely fixed to the operating plate 62 of the lock canceling mechanism 60 has a construction to even come close to the bottom wall of the switch proper, it becomes possible to use the machine screw 63 and cancel the lock mechanism by manual operation from the inside of the room such as machine room, etc. For example, as shown in FIG. 29, if a long round through hole 201*d* for moving the machine screw 63 is mounted to the bottom surface 201*c* of the switch proper 201 and the operation hole 103*a* is opened in the door 103, it becomes possible to cancel the lock of the actuator 102 by manual operation by inserting a tool such as precision screwdriver 360, etc., as shown in FIG. 30, in the switch proper 201 through the operation hole 103*a* or the long round through hole 201*d* to move the machine screw 63, and with this configuration, it becomes possible to cancel the mechanical lock of the actuator 102 by manual operation from the machine room inside even if the worker mistakenly closes the door 103 or the door 103 closes due to some reason when the worker is inside the machine room, thereby freeing the fear of the worker being confined in the machine room.

In each of the embodiments of FIG. 17, FIG. 24 or FIG. 27 above, the operating portion 211 and switch portion 212 and the solenoid mechanism portion 213 are made integral, but this invention shall not be restricted to this but it is possible to take a form in which the safety switch is divided into a switch proper unit equipped with the operating portion and the switch portion and a unit equipped with the solenoid mechanism portion as shown in FIG. 1 and these switch proper unit and the solenoid unit are connected to form a safety switch.

Figure 31:
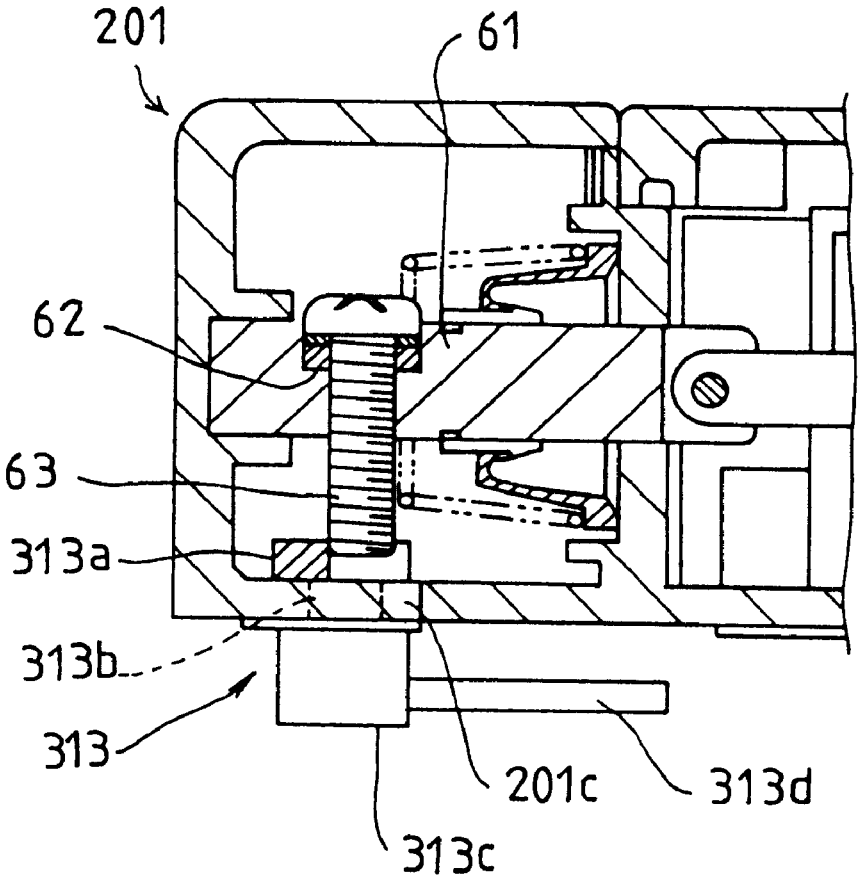
FIG. 31 is a partial cross sectional view showing an example using a canceling lever which moves a small screw in the first embodiment of the present invention.
Figure 32:
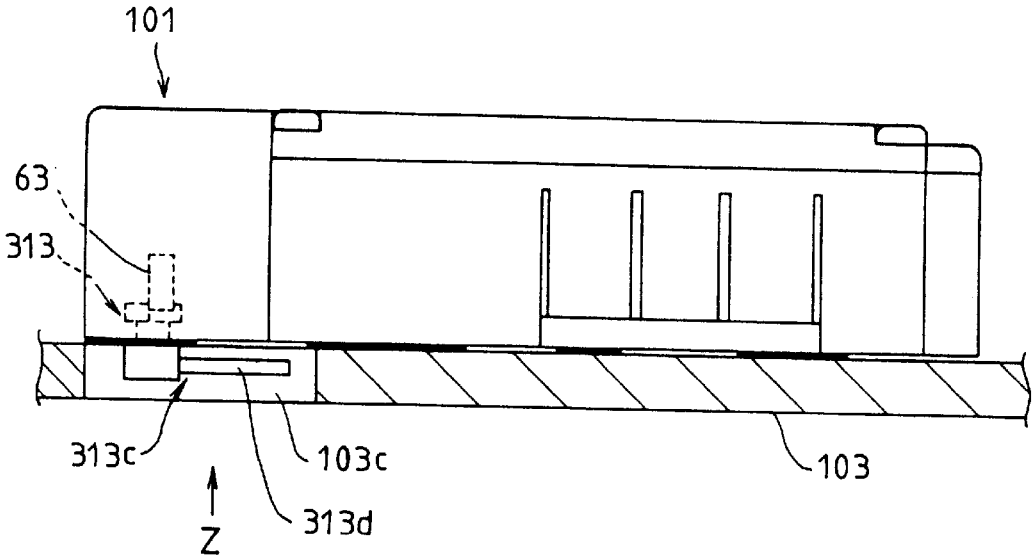
FIG. 32 is a side view showing the first embodiment shown in FIG. 31 under the applied condition.
Figure 33:
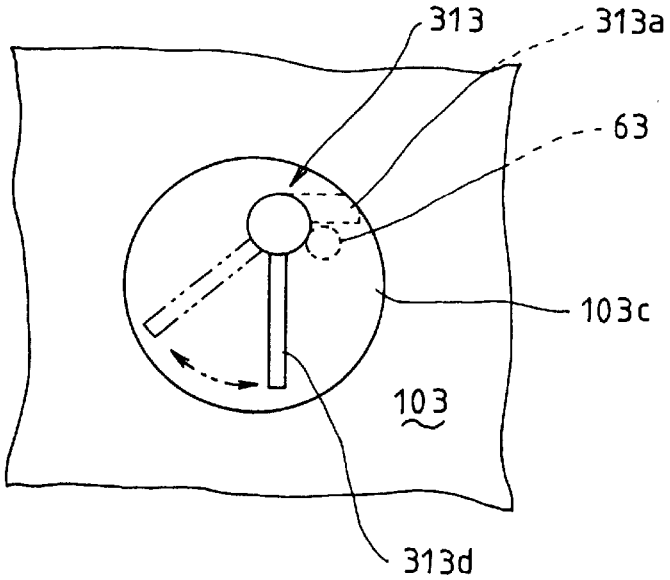
FIG. 33 is a view on arrow Z in FIG. 32.

When the configuration to cancel the lock from the machine room inside using the machine screw 63 of the lock canceling mechanism 60 as described above is added, a member such as canceling lever, etc. for moving the machine screw 63 may be installed to the rear surface side of the switch proper 201. Now, the example in which the canceling lever is installed is described referring to FIG. 31–FIG. 35. FIG. 31 is a cross-sectional view showing the operating portion, which is the essential configuration of this example, FIG. 32 is a side view showing the applied condition of this example, FIG. 33 is a view on arrow Z in FIG. 32, FIG. 34 a perspective showing the construction of the releasing lever 313 using in this example, and FIG. 35 (A), (B) illustrations showing the operation of the canceling lever 313.

In the example, it is characterized in that the end portion of the machine screw 63 that securely fixes the operating plate 62 to the operating rod 61 of the solenoid is designed to pass through the operating rod 61 and come close to the bottom wall 201*c*, and the machine screw 63 is configured to be used as a lock canceling pin, and at the same time, a canceling lever 313 for moving the machine screw 63 is installed.

Figure 34:
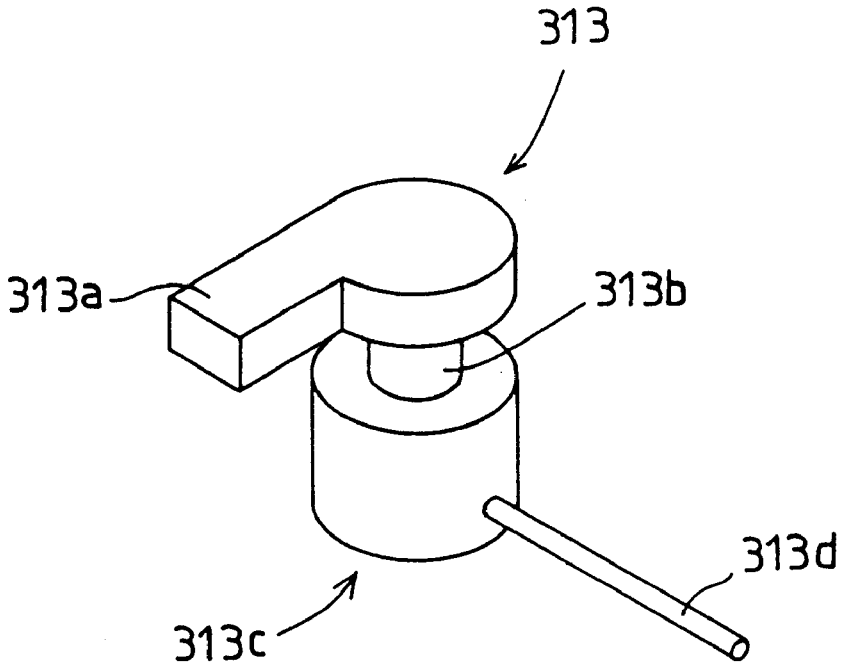
FIG. 34 is a perspective view showing the construction of the canceling lever 313 used in the first embodiment shown in FIG. 31.

The canceling lever 313 comprises a lever piece 313*a* for pressurizing the machine screw 63, rotating shaft 313*b* that serves as a fulcrum, and an operating portion 313*c* equipped with a handle 313*d*, as shown in the perspective of FIG. 34, and as shown in FIG. 31, the rotating shaft 313*b* is rotatably supported around the axis parallel to the center of the machine screw 63 to the bottom wall 201*c* of the switch proper 201. The safety switch equipped with a canceling lever 313 of this kind of construction, that is, the operating portion 313*c* has a construction to expose to the fixing surface side (rear surface side) of the switch proper 201, can be operated from the inside of the machine room by keeping the operating hole 103*c* open of the door 103 as shown in FIG. 32 and FIG. 33.

Figure 35:
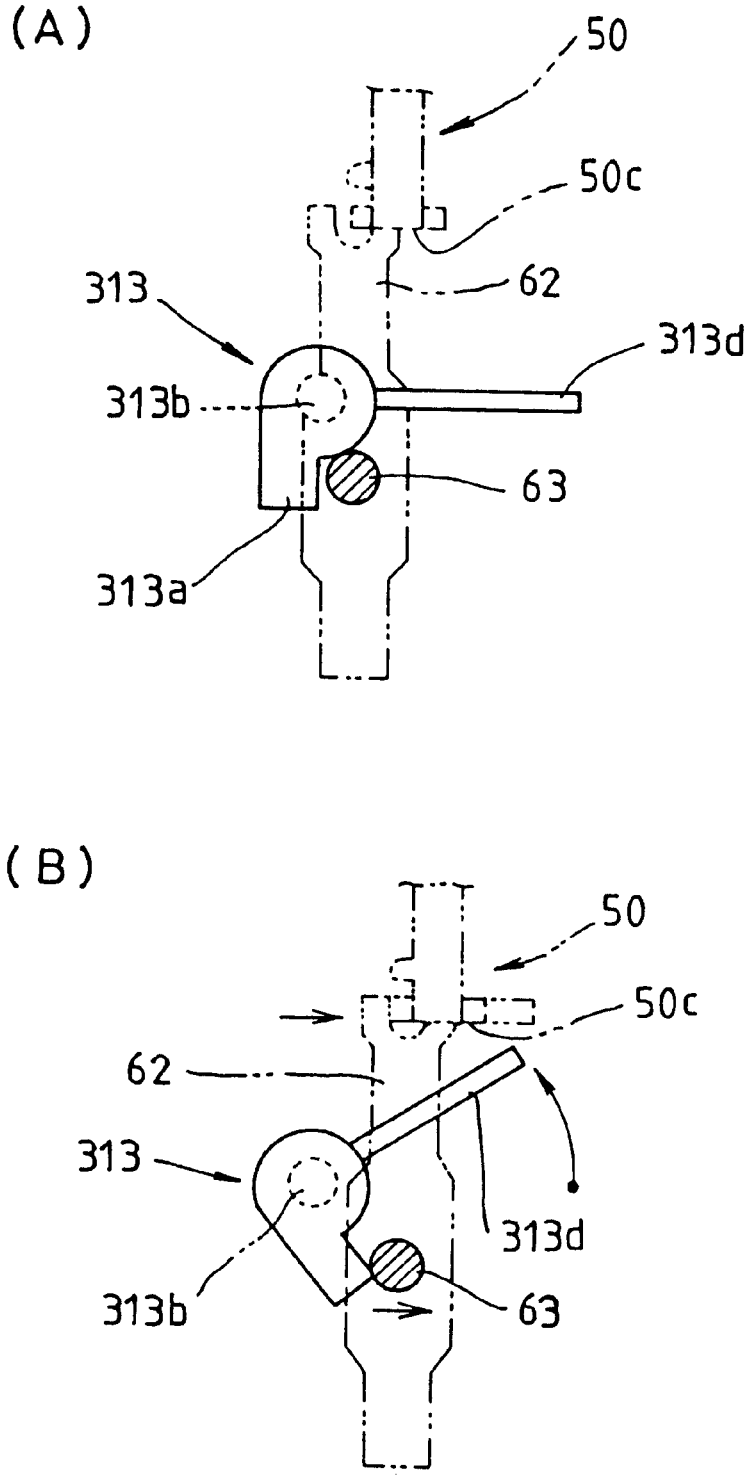
FIG. 35 (A), (B) illustrates the operation of the canceling lever 313, respectively.

Referring now to FIG. 35 (A), (B), the operation of the canceling lever 313 of the above construction will be described.

First of all, as the door 103 is closed and the actuator 102 advances into the operating portion 211, the rotation of the driving cam 1 and restricting plates 2, 3 are prevented by the lock lever 50, bringing the actuator 102 to the mechanically locked condition. Under this condition, the lever piece 313*a* of the canceling lever 313 is held at standstill in the position crossing at right angle to the moving direction of this machine screw 63, and the handle 313*d* is located along the direction parallel to the moving direction of the machine screw 63 as shown in FIG. 35 (A).

From the above condition, rotating the handle 313*d* of the canceling lever 313 counterclockwise (about 45° at maximum) presses the machine screw 63 in the retracting direction by the rotation of the lever piece 313*a* and the operating plate 62 retracts. By this, the engaging piece 50*a* of the lock lever 50 disengages from the lock step portion 1*d* of the cam 1 and the lock of the actuator 102 is canceled, and the door 103 is ready for opening.

Consequently, because it is possible to cancel the mechanical lock of the actuator 102 by manual operation from the machine room inside even if the worker mistakenly closes the door 103 or the door 103 closes due to some reason when the worker is inside the machine room, there is no fear of the worker being confined in the machine room.

In the above example, the end portion of the machine screw 63 is constructed to come closer to the lower side of the operating rod 61 and to be used for a lock canceling pin, but this invention shall not be restricted to this construction, and it may be constructed to use the machine screw 63 as a component specialized for securely fixing the operating plate 62 to the operating rod 61, to integrally form a protruding piece on the lower side of the operating rod 61, and to use this protruding piece for a lock canceling pin. It is also possible to machine a stepped through hole extending in the vertical direction on the operating rod 61, to this through hole inside, a T-letter shape pressurizing piece is inserted, and the portion of this T-letter shape pressuring piece protruding to the lower side of the operating rod 61 may be used for a lock canceling pin.

In addition, as still another canceling means, it is possible to adopt a construction to equip an engaging recessed portion to the lower surface side of the operating rod 61 as well as a protruded portion at the canceling lever 313, and to hitch the protruding portion on this lever side to the engaging recessed portion on the rod side, and to manually cancel the lock mechanism of the actuator 102 by hitching a tip end of the screwdriver or other tool to the rod side engaging recessed portion.

What is claimed is:

1. A safety switch, comprising:

an actuator which enters an operating portion of the switch to move an operating rod of a switch portion in response to this, and a connection contact is changed over, wherein the actuator includes an inserting portion to the operating portion which comprises a pressurizing piece at one end and a supporting piece for supporting the pressurizing piece, wherein the pressurizing piece includes protruded portion pressurizing surfaces located on both end portions and a recessed portion pressurizing surface located in-between are formed on the pressuring piece, wherein the operating portion comprises:

a driving cam that rotates in response to the advance and retraction of the actuator;

restricting plates that are located on both sides of the driving cam and which can rotate around the rotation center of the driving cam, respectively and;

a cam follower pin connected to the end portion of the operating rod, whose both ends extend to the side of the driving cam, wherein the driving cam includes a groove cam that displaces the cam follower pin in the moving direction of the operating rod, wherein each of the restriction plates includes a notch serving as a pin engaging portion located on a moving passage of the cam follower pin in the initial condition where the actuator is not inserted and for restricting the movement of the follower pin and an elastic member that returns the restricting plates to the initial condition, respectively, wherein the movement of the cam follower pin is stopped by the restricting plate to restrict the rotation of the driving cam only when the driving cam is rotated under an initial condition, and when the actuator is inserted, the driving cam is pressed by the recessed portion pressurizing surface at the tip end as well as the restricting plates are pressed by the protruded portion pressurizing surfaces, and both the driving cam and the restricting plates rotate together to move the operating rod, wherein the driving cam includes a hollowed-out portion extending from the circumferential surface to the rotation center of the driving cam in a specified width formed at the portion corresponding to the groove cam forming portion, and the end portion of the operation rod is inserted into the hollowed-out portion and the cam follower pin is connected to the rod end portion, and wherein the pin engaging portion of the restriction plates is a notch formed in the profile into which the cam follower pin fits.

2. A safety switch as recited in claim 1, further comprising a pin guide member equipped with guide grooves for restricting the follower pin movement direction to one direction on both end portions of the cam follower pin.

3. A safety switch as recited in claim 1, wherein the driving cam and the restriction plates located on both sides thereof are rotatably supported on the same shaft independently of each other.

4. A safety switch as recited in claim 1, wherein the driving cam and the restricting plates are located in such a manner to generate a rotation phase difference equivalent to a level difference between the actuator protruded portion pressurizing surfaces and recessed portion pressurizing surface of the actuator between the driving cam and the restricting plates when they are in the initial condition.

5. A safety switch as recited in claim 1, wherein on the circumferential surface of the driving cam, a recessed portion that allows the pressuring piece of the actuator to fit in is formed, and by advance of the actuator to the operating portion, the pressurizing piece of the actuator fits in to the recessed portion of the driving cam circumferential surface when the driving cam is rotated.

6. A safety switch asa recited in claim 5, wherein the recessed portion to which the pressurizing piece of the actuator fits in is formed at two places on the circumferential surface of the driving cam, and an inserting hole of the actuator is equipped at two places of the operating portion.

7. A safety switch as recited in claim 1, wherein the notch is semi-circular.

8. A safety switch as recited in 1, wherein the notch is rectangular.

9. A safety switch as recited in claim 1, wherein the restricting plates include a relief hole for the cam follower pin, and on the edge portion of the relief hole, the notch is formed.

10. A safety switch as recited in claim 1, wherein the pin engaging portion of the restricting plates is a hook-shape engaging piece formed integral to a restricting piece.

11. A safety switch as recited in claim 1, wherein the elastic member is a torsion coil spring.

12. A safety switch as recited in claim 1, wherein the elastic member is a compression coil spring.

13. A safety switch as recited in claim 1, wherein the elastic member is a tension coil spring.

14. A safety switch as recited in claim 1, wherein the elastic member is a plate spring.

15. A safety switch as recited in claim 14, wherein the plate spring is formed integral with the restricting plate.

16. A safety switch as recited in claim 1, wherein the driving cam and the restricting plates are plastic moldings.

* * * * *